US011137183B2

(12) United States Patent
Cosby, II et al.

(10) Patent No.: US 11,137,183 B2
(45) Date of Patent: Oct. 5, 2021

(54) PHOBIC/PHILIC STRUCTURES IN REFRIGERATION SYSTEMS AND LIQUID VAPOR SEPARATION IN REFRIGERATION SYSTEMS

(71) Applicant: TRANE INTERNATIONAL INC., Davidson, NC (US)

(72) Inventors: Ronald Maurice Cosby, II, La Crosse, WI (US); Stephen Anthony Kujak, Onalaska, WI (US); Jay Johnson, Houston, MN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 16/673,138

(22) Filed: Nov. 4, 2019

(65) Prior Publication Data

US 2020/0064035 A1 Feb. 27, 2020

Related U.S. Application Data

(63) Continuation of application No. 14/675,136, filed on Mar. 31, 2015, now Pat. No. 10,465,956.
(Continued)

(51) Int. Cl.
*F25B 43/02* (2006.01)
*F04C 29/02* (2006.01)
(Continued)

(52) U.S. Cl.
CPC ..... *F25B 43/02* (2013.01); *F04C 29/026* (2013.01); *F28F 19/02* (2013.01);
(Continued)

(58) Field of Classification Search
CPC ..... F28B 43/02; F28F 19/02; F28F 2245/00; F28D 1/0213; F28D 2021/0068;
(Continued)

(56) References Cited

U.S. PATENT DOCUMENTS 5,561,987 A 10/1996 Hartfield et al.
5,806,326 A 9/1998 Watanabe et al.
(Continued)

FOREIGN PATENT DOCUMENTS

BE 1017442 9/2008
CN 101523149 9/2009
(Continued)

OTHER PUBLICATIONS

International Search Report and Written Opinion for International Application No. PCT/US2015/023653, dated Aug. 11, 2015. 13 pages.
(Continued)

*Primary Examiner* — Steve S Tanenbaum
(74) *Attorney, Agent, or Firm* — Hamre, Schumann, Mueller & Larson, P.C.

(57) ABSTRACT

Oleophobic and/or philic surface(s) are utilized for oil separation, direction, and/or collection in a refrigeration system. Surfaces of component(s) of a refrigeration system (compressor, oil separator, evaporator, etc.) are produced to be oleophobic or philic. The oleophobic and/or philic surfaces are utilized to direct a flow path of oil within the refrigeration system or to prevent oil connection in an area. Refrigerant phobic and/or lubricant phobic material(s) also may be utilized to help promote separation of refrigerant vapor from refrigerant liquid and/or from oil in refrigeration systems.

5 Claims, 14 Drawing Sheets

Related U.S. Application Data

(60) Provisional application No. 61/972,714, filed on Mar. 31, 2014, provisional application No. 61/972,705, filed on Mar. 31, 2014.

(51) Int. Cl.

| | |
|---|---|
| ***F28F 19/02*** | (2006.01) |
| ***F28D 21/00*** | (2006.01) |
| ***F04C 18/02*** | (2006.01) |
| ***F28D 7/16*** | (2006.01) |
| ***F25B 31/00*** | (2006.01) |
| ***F28D 1/02*** | (2006.01) |

(52) U.S. Cl.
CPC ..... *F04C 18/0215* (2013.01); *F04C 2230/91* (2013.01); *F04C 2230/92* (2013.01); *F05C 2225/00* (2013.01); *F25B 31/004* (2013.01); *F28D 1/0213* (2013.01); *F28D 7/16* (2013.01); *F28D 2021/0068* (2013.01); *F28F 2245/00* (2013.01)

(58) Field of Classification Search
CPC ..... F28D 7/16; F04C 2230/92; F04C 29/026; F04C 2230/91; F04C 18/0215; F05C 2225/00
USPC ..... 62/84
See application file for complete search history.

(56) References Cited

U.S. PATENT DOCUMENTS

| | | | |
|---|---|---|---|
| 5,840,198 | A | 11/1998 | Clarke |
| 7,086,238 | B2 | 8/2006 | Stein |
| 7,485,234 | B2 | 2/2009 | Max |
| 7,624,790 | B2 | 12/2009 | Max |
| 8,048,309 | B2 | 11/2011 | Osegovic et al. |
| 8,419,836 | B2 | 4/2013 | Ardizzone |
| 8,893,688 | B2 | 11/2014 | Ruppel et al. |
| 2003/0070911 | A1 | 4/2003 | Koh et al. |
| 2010/0033933 | A1 | 2/2010 | Hashimoto et al. |
| 2010/0115950 | A1 | 5/2010 | Haje et al. |
| 2010/0326922 | A1 | 12/2010 | Varanasi et al. |
| 2011/0107512 | A1 | 5/2011 | Gilbert |
| 2011/0138838 | A1 | 6/2011 | Despesse |
| 2012/0118722 | A1 | 5/2012 | Holtzapple et al. |
| 2014/0014565 | A1 | 1/2014 | Qin |

FOREIGN PATENT DOCUMENTS

| | | | |
|---|---|---|---|
| CN | 102778091 | | 11/2012 |
| FR | 2807825 | | 10/2001 |
| JP | S614877 A | * | 1/1986 |
| JP | 2005-069654 | | 3/2005 |
| WO | 2013/049166 | | 4/2013 |

OTHER PUBLICATIONS

Chinese Office Action, Chinese Patent Application No. 2015800264765, dated Jun. 26, 2018, with partial English translation, 9 pages.

* cited by examiner

PHOBIC/PHILIC STRUCTURES IN REFRIGERATION SYSTEMS AND LIQUID VAPOR SEPARATION IN REFRIGERATION SYSTEMS

The embodiments disclosed herein relate generally to refrigeration and/or HVAC (heating, ventilation, and air conditioning) systems. More particularly, the embodiments relate to utilizing oleophobic and/or philic surface(s) for oil separation, direction, and/or collection in refrigeration and/or HVAC systems. Embodiments also relate to applications of materials and/or structures to promote liquid/vapor separation in refrigeration and/or HVAC systems.

BACKGROUND

A refrigeration and/or HVAC system generally includes a compressor, a condenser, an expansion device, and an evaporator. FIG. 1 illustrates a schematic diagram of components of a typical refrigeration system 1. In a refrigeration cycle, a circulating refrigerant enters a compressor 2 as a vapor. The refrigerant vapor is compressed and exits the compressor 2 as a vapor at a higher temperature and/or pressure. The refrigerant vapor at the higher temperature travels through a condenser 3 which cools the refrigerant vapor until the refrigerant vapor starts condensing, and then condenses the refrigerant vapor into a refrigerant liquid by removing additional heat. The refrigerant liquid goes through an expansion device 4 where the pressure of the refrigerant liquid can abruptly decrease, causing flash evaporation and auto-refrigeration of a portion of the refrigerant liquid. That results in a mixture of refrigerant liquid and vapor at a lower temperature and/or pressure. The cold refrigerant liquid-vapor mixture then travels through an evaporator 5 to exchange heat with another fluid, e.g., warm air being blown by a fan across the evaporator 5, and is vaporized. The resulting refrigerant vapor returns to the compressor 2 to complete the refrigeration cycle.

SUMMARY

The embodiments disclosed herein relate generally to refrigeration and/or HVAC systems. More particularly, the embodiments relate to utilizing oleophobic and/or philic surface(s) for oil separation, direction, and/or collection in refrigeration and/or HVAC systems. In refrigeration and/or HVAC systems, for example, that may include a chiller or unitary rooftop equipment or split systems, there may be a need to obtain separation of refrigerant liquid from refrigerant vapor, and/or separation of oil from refrigerant vapor. It is to be appreciated that the embodiments described herein can be applied to other industrial or commercial systems where oil separation, direction, and/or collection may be desired and/or needed.

In the embodiments described herein, surfaces of component(s) of a refrigeration system are produced to be oleophobic or philic. The oleophobic and/or philic surfaces are utilized to direct a flow path of oil within the refrigeration system or to prevent oil collection in an area.

Current refrigeration, HVAC, and/or HVACR (heating, ventilation, air conditioning, and refrigeration) systems typically utilize management of refrigerant vapor and/or liquid flow streams, via, for example, channels, valves, pumps, etc., for oil separation and/or oil direction in components of the systems.

The embodiments described herein can enhance the efficiency of managing lubricant vapor and/or liquid flow streams, for example, directing oil, collecting oil, and/or separating oil from other fluids within the refrigeration and/or HVAC systems by utilizing oleophobic and/or philic surface(s) on components of the refrigeration and/or HVAC systems. It is to be appreciated that the embodiments described can be utilized in industrial/commercial systems for directing oil, collecting oil, and separating oil from other fluids in pumps, valves, oil flow streams, air compressors, heat exchangers, etc.

It is to be understood that the embodiments described herein can be applied to industrial and/or commercial systems other than refrigeration and/or HVAC systems, to direct oil, collect oil, and/or separate oil from other fluid(s) in, for example, pumps, valves, oil flow streams, air compressors, heat exchangers, etc.

It is also to be understood that the oleophobic or philic surfaces described herein can be tailored to be phobic or philic for fluid other than oil (e.g., refrigerant).

In one embodiment, a compressor in a refrigeration system includes an inner surface area exposed to the inside of the compressor. When the compressor operates, a lubricant flowing inside the compressor comes into contact with the inner surface area. The inner surface area is configured to be a lubricant phobic or philic surface so as to direct the flow of the lubricant to a desired area of the compressor.

In one embodiment, an oil separator in a refrigerant system for separating oil from a refrigerant/oil mixture is provided. The oil separator includes an inner surface area exposed to the inside of the oil separator. When the oil separator operates, at least a portion of the separated oil and/or the refrigerant/oil mixture comes into contact with the inner surface area. The inner surface area is configured to be an oleophobic or philic surface so as to direct the flow of oil and help to separate the oil from the refrigerant.

In one embodiment, an evaporator in a refrigerant system includes an inner surface area exposed to the inside of the evaporator. When the evaporator operates, oil inside the evaporator comes into contact with the inner surface area. The inner surface area configured to be an oleophobic or philic surface so as to direct the flow of oil.

The term "oleophobic surface" described herein refers to a surface of material that exhibits a phobic effect for lubricant, e.g. oil, in contact with the surface. When oil comes in contact with the oleophobic surface, there is a lack of affinity or repulsion between the oleophobic surface and the oil to separate the oil from the oleophobic surface so that the oil has a tendency to aggregate to reduce a contact area therebetween for oil beading.

The term "oleoleophilic surface" described herein refers to a surface of material that exhibits a philic effect for lubricant, e.g. oil, in contact with the surface. When oil comes in contact with the oleophilic surface, the oleophilic surface has an affinity for, attracting, adsorbing, or absorbing the oil and the oil can attain a relatively large contact area with the oleophilic surface to prevent oil beading.

For purposes of the description, the term "oil" is used however, such use is not meant to be limiting as the phobic and/or philic surfaces and/or structures may be employed for various lubricant types.

Liquid Vapor Separation

The embodiments described herein are directed to applications of materials and/or structures to promote refrigerant liquid/vapor separation and/or oil/refrigerant vapor separation in refrigeration and/or HVAC systems.

In refrigeration and/or HVAC systems, for example, that may include a chiller or unitary rooftop equipment or split systems, there may be a need to obtain separation of refrigerant liquid from refrigerant vapor, and/or separation of oil from refrigerant vapor. For example, it may be useful to apply the separation concepts to the system shown in FIG. 1, for example, refrigerant liquid can be separated from a refrigerant liquid-vapor mixture from a condenser, e.g., the condenser 3, and directed to an evaporator, e.g., the evaporator 5, for a single phase distribution. An oil separator can be used to separate refrigerant and/or oil from a refrigerant vapor/oil mixture from a compressor, e.g., the compressor 2 where the separated refrigerant vapor can be directed to a condenser, e.g., the condenser 3, and the separated oil can be directed back to the compressor. It will be appreciated that FIG. 1 shows a general vapor compression system, the principles of which may be applied in HVAC type systems and, while a lubricant (e.g. oil) separator is not shown, it will also be appreciated that the system of FIG. 1 may include a suitable oil separator as desired and/or necessary. There is also need to decrease refrigerant liquid carryover when refrigerant vapor is directed out of an evaporator, e.g., the evaporator 5. However, the efficiency of the separation may be impacted due to footprint and/or height requirements for the refrigeration/HVAC systems.

In the embodiments described herein, refrigerant phobic and/or lubricant phobic materials and/or structures are utilized to help promote separation of refrigerant vapor from refrigerant liquid and/or from oil in refrigeration and/or HVAC systems. The refrigerant phobic and/or lubricant phobic materials are disposed within the refrigeration and/or HVAC systems to repel refrigerant liquid and/or lubricant to increase the efficiency of, for example, separating refrigerant liquid from refrigerant vapor and/or separating oil from refrigerant vapor. The term "refrigerant phobic and/or lubricant phobic" described herein refers to materials and/or structures that are phobic for refrigerant liquid, lubricant liquid (e.g., oil), and/or a liquid mixture of refrigerant and lubricant (e.g., oil).

In some embodiments, the refrigerant phobic and/or lubricant phobic materials can be arranged as a specific form, e.g., a screen that allows refrigerant vapor to pass through but does not allow liquid droplets (refrigerant and/or oil) to penetrate therethrough.

In some embodiments, structure(s) and/or surfaces of component(s) of refrigeration and/or HVAC systems can include the refrigerant phobic and/or lubricant phobic materials for promoting separation of refrigerant vapor from refrigerant liquid and/or from oil.

In some embodiments, the refrigerant phobic and/or lubricant phobic materials can include, by way of example but are not limited to, any one or more of expanded polytetrafluoroethylene (ePTFE), polypropylene, polyesterterephthalate, polyurethane, etc.

In some embodiments, the refrigerant phobic and/or lubricant phobic materials can be in the form of membrane(s). In some embodiments, the refrigerant phobic and/or lubricant phobic materials can be impregnated with milli/micro/nano-fibers or milli/micro/nano-structures to repel refrigerant or lubricants to increase the efficiency of the materials for liquid/vapor separation in refrigeration and/or HVAC systems.

In some embodiments, a method for separating refrigerant vapor from refrigerant liquid and/or from oil is provided. A mixture of refrigerant liquid and refrigerant vapor, and/or a mixture of refrigerant vapor and oil, can be directed through refrigerant phobic and/or lubricant phobic materials and/or structures that allow the refrigerant vapor to pass through, repel the refrigerant liquid and/or oil, and do not allow the refrigerant liquid and/or oil to pass therethrough.

The embodiments described herein can be used for example (i) in refrigerant liquid/vapor separation for better refrigerant liquid distribution in a heat exchanger; (ii) in augmentation of oil separation from refrigerant vapor in an oil separator; (iii) in prevention of liquid carryover from an evaporator to a compressor with the refrigerant phobic and/or lubricant phobic materials in a specific form (e.g., membrane) acting as a liquid carryover abatement device within an evaporator; and/or (iv) in prevention of liquid carryover from an economizer to a compressor with the refrigerant phobic in a specific form (e.g., membrane) acting as a liquid carryover abatement device within an economizer.

In one embodiment, a refrigeration and/or HVAC system includes: an expansion device, and a refrigerant liquid/vapor separator downstream of the expansion device. The refrigerant liquid/vapor separator receives a refrigerant liquid/vapor mixture from the expansion device. A distributor downstream of the refrigerant liquid/vapor separator is configured to receive refrigerant liquid from the refrigerant liquid/vapor separator. An evaporator is fluidly connected to the distributor for receiving the refrigerant liquid distributed by the distributor. The refrigerant liquid/vapor separator contains refrigerant phobic and/or lubricant phobic materials for helping to promote separation of refrigerant liquid from refrigerant vapor. In one embodiment, an oil separator for a refrigeration and/or HVAC system includes a tank. The tank includes an inlet for receiving a mixture of refrigerant vapor and oil, an oil outlet at a bottom region of the tank for directing out liquid oil, and a vapor outlet for directing out refrigerant vapor. The vapor outlet extends into the inside of the tank and has an open end facing the inside of the tank. An oil barrier device is disposed at the open end of the vapor outlet. The oil barrier device includes refrigerant liquid phobic and/or lubricant phobic materials for preventing oil from exiting the tank while allowing for the refrigerant vapor to penetrate therethrough and exit the tank via the vapor outlet.

In one embodiment, an evaporator in a refrigeration and/or HVAC system, includes an evaporator body, a suction duct disposed at a vapor outlet of the body for directing refrigerant vapor out of the evaporator, and a liquid carryover abatement device disposed at an inlet of the suction duct for allowing the refrigerant vapor to penetrate and for preventing refrigerant liquid and/or oil from exiting the evaporator. The liquid carryover abatement device includes refrigerant phobic and/or lubricant phobic materials.

In one embodiment, an economizer for example, which may be employed in a multiple stage refrigeration and/or HVAC system, includes an economizer body, a suction duct disposed at a vapor outlet of the body for directing refrigerant vapor out of the evaporator, and a liquid carryover abatement device disposed within the economizer body or prior to the inlet of the suction duct for allowing the refrigerant vapor to penetrate and for preventing refrigerant liquid from exiting the economizer. The liquid carryover abatement device includes refrigerant phobic and/or lubricant phobic materials.

In another embodiment, a compressor internal oil separator for a refrigeration system includes a housing that includes an open end configured to receive a mixture of refrigerant vapor and oil from an inside of a compressor, and a vapor outlet configured to direct out refrigerant vapor. One or more partitions are disposed within the housing and configured to separate the open end from the vapor outlet. One or more of the partitions include a phobic and/or lubricant phobic material for preventing oil from passing through the partition(s) while allowing for the refrigerant vapor to penetrate therethrough and exit the housing via the vapor outlet. The separated oil is collected in a bottom area of the housing.

The term "refrigerant phobic and/or lubricant phobic material(s) and/or structure(s)" described herein refers to materials and/or structures that exhibit a phobic effect for refrigerant liquid and/or lubricant (e.g., oil). When a mixture of refrigerant liquid and refrigerant vapor, and/or a mixture of refrigerant vapor and oil, is directed through the refrigerant phobic and/or lubricant phobic materials and/or structures, the refrigerant phobic and/or lubricant phobic material(s) and/or structure(s) allow refrigerant vapor to pass through and do not allow refrigerant liquid and/or oil to pass through.

DETAILED DESCRIPTION

The embodiments disclosed herein relate generally to refrigeration and/or HVAC systems. More particularly, the embodiments relate to utilizing oleophobic and/or philic surface(s) for oil separation, direction, and/or collection in refrigeration and/or HVAC systems.

In the embodiments described herein, surfaces of component(s) of refrigeration and/or HVAC systems are produced to be oleophobic or philic. The oleophobic and/or philic surfaces are utilized to direct a flow path of oil within the refrigeration system or to prevent oil collection in an area.

It is to be understood that the embodiments described herein can be applied to industrial and/or commercial systems other than refrigeration and/or HVAC systems, to direct oil, collect oil, and/or separate oil from other fluid(s) in, for example, pumps, valves, oil flow streams, air compressors, heat exchangers, etc.

In some embodiments, an oleophobic or philic surface can be created through use of millimeter or micrometer and/or nanometer sized structure(s) on the surface of the component(s). In some embodiments, the oleophobic or philic surfaces can be created through structures formed directly into the material of components of the refrigeration system. For example, milli, micro, and/or nanostructure(s) can be formed into the material of an oil separator, e.g., steel.

In some embodiments, an oleophobic or philic surface can be created through coating(s) that can be applied to the surfaces. The coating(s) can be applied to the surface by, for example, spray painting, dipping, taping via an adhesive, etc. In some embodiments, the coating(s) can include nanoparticles and/or other materials.

In some embodiments, an oleophobic or philic surface can utilize stamped or pressed types of surfaces.

In some embodiments, an oleophobic surface can include, by way of example but are not limited to, expanded polytetrafluoroethylene (ePTFE), polypropylene, polyesterterephthalate, polyurethane, etc.

In some embodiments, an oleophobic or philic surface can be in the form of membrane(s). In some embodiments, an oleophobic or philic surface can include oleophobic or philic material(s) impregnated with nano-fibers or nano-structures to be oleophobic or philic.

In some embodiments, the geometries of the oleophobic or philic surfaces can be created and/or adjusted according to a specific oil type and/or application.

Figure 1:
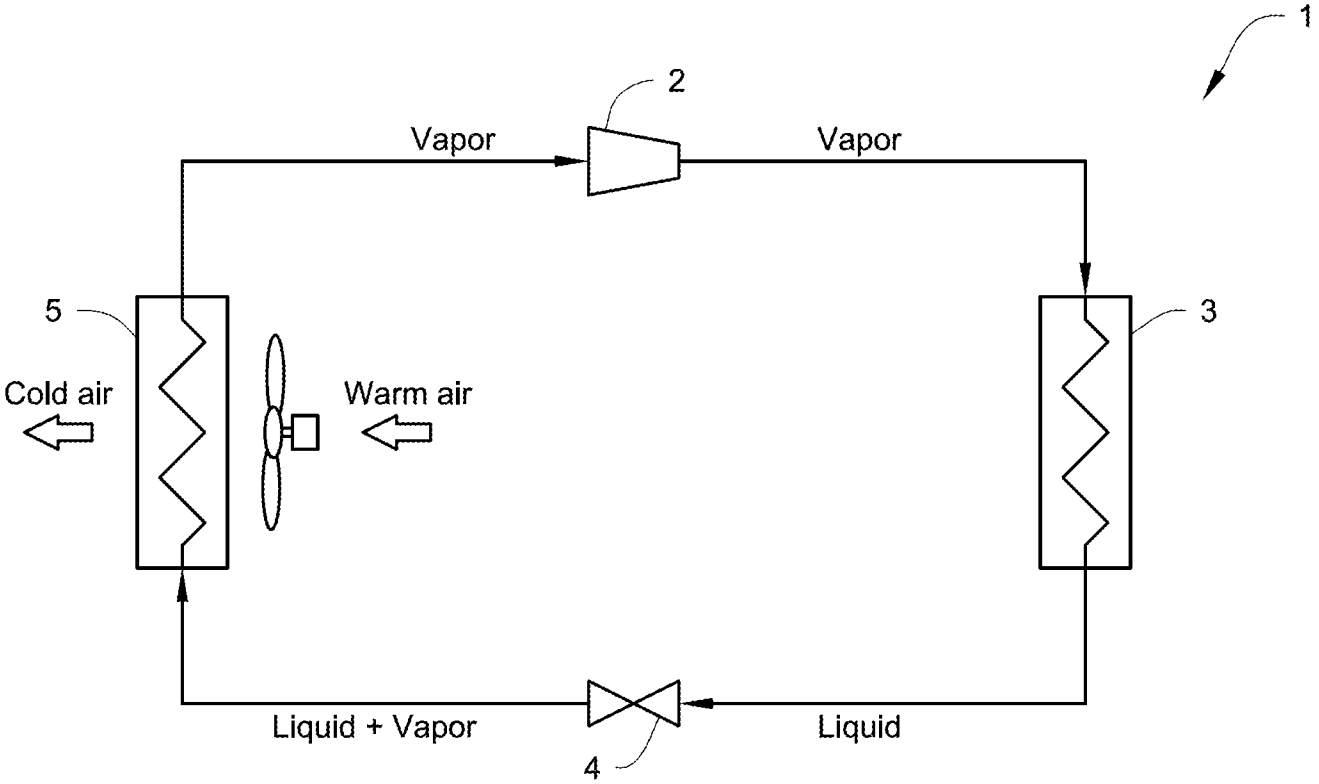
Fig. 1 (Prior Art)
FIG. 1 illustrates a schematic diagram of a typical refrigeration system.
Figure 2A:
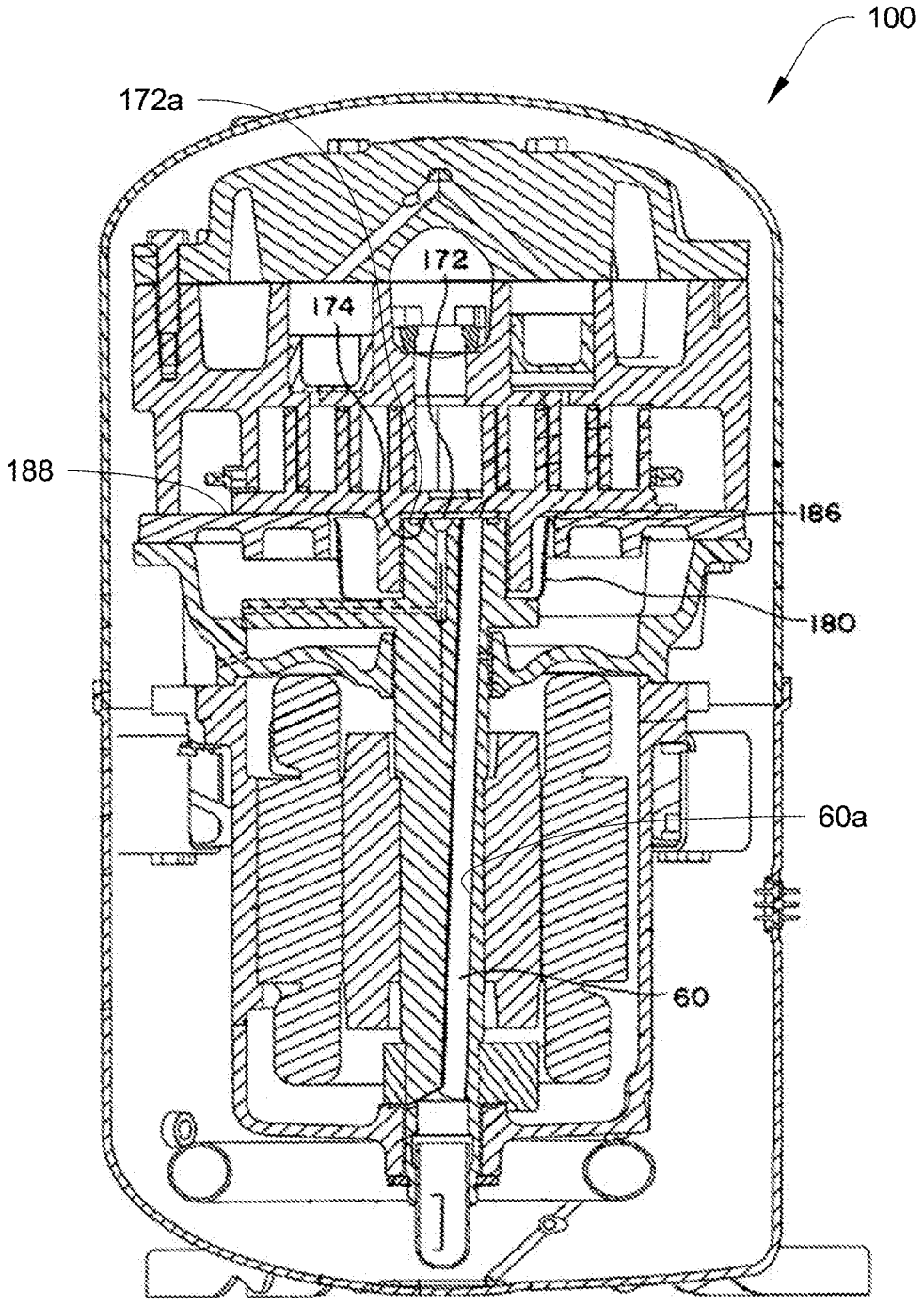
FIG. 2A illustrates a cross sectional view of a compressor that utilizes oleophobic and/or philic surfaces to direct oil flow inside the compressor, according to one embodiment.
Figure 2B:
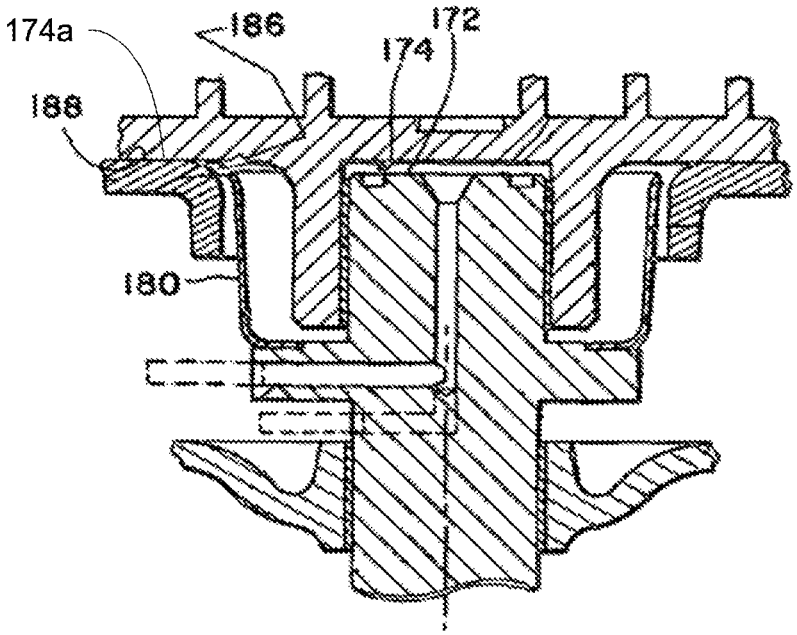
FIG. 2B illustrates an enlarged portion of the compressor of FIG. 2A.

FIG. 2A illustrates a compressor 100 that utilizes oleophobic and/or philic surfaces to direct oil flow inside the compressor 100, according to one embodiment. FIG. 2B illustrates an enlarged portion of the compressor 100. In the embodiment shown in FIGS. 2A and 2B, the compressor 100 is a scroll compressor. It is to be understood that the oleophobic and/or philic surfaces can be used in other types of compressors such as, for example, a screw compressor, a scroll compressor, a centrifugal compressor, as may be used in refrigeration and/or HVAC systems, or can be used in air compressors, pumps, or other systems/components that require oil lubrication.

The compressor 100 includes an oil gallery passage 60 that is defined by a passage wall 60*a*. The compressor 100 further includes an inlet 172 disposed at one end of the oil gallery passage 60. The inlet 172 is in fluid communication with the oil gallery passage 60 and defined by an inlet wall 172*a*. The surface of the passage wall 60*a* and/or the surface of the inlet wall 172*a* can be configured to be oleophilic surface(s). When the oil inside the compressor 100 comes into contact with the passage wall 60*a* and/or the inlet wall 172*a*, the oil can be attracted, adsorbed, or absorbed on the surface thereof. This can help to collect the oil, direct the oil to the inlet 172 and direct the oil to an oil cup 180. As shown in FIG. 2B, the oil then can be directed, via, for example, rotation, to an interface 186 between a lower surface 174*a* of an orbiting scroll end plate 174 and a thrust surface 188.

The embodiment illustrated in FIGS. 2A and 2B shows oleophilic surfaces for retaining oil that comes into contact with the surfaces of the components 60 and 172. In some embodiments, oleophobic surface(s) can be utilized for components of the compressor 100 so as to drive the oil to the interface 186. For example, an oleophobic surface can be utilized for an oil sump surface where oil can be collected and directed out for start-up conditions. It is to be understood that oleophilic surface(s) and oleophobic surface(s) can be used in a combination for directing oil flow within the compressor 100.

It is to be understood that oleophilic surface(s) and/or oleophobic surface(s) can be created on any suitable location within a compressor other than the surface of the walls 60*a* and 172*a* shown in FIGS. 2A-B.

Oleophilic surface(s) and/or oleophobic surface(s) can be created on appropriate components of a compressor for helping to enhance and/or maintain oil flow within the compressor. Utilization of the oleophilic surface(s) and/or oleophobic surface(s) can enable better oil circulation and/or distribution during operating conditions.

It is to be understood that when refrigerant is used as a lubricant for a compressor, for example, in a refrigerant cooled compressor application, refrigerant phobic surface(s) and/or refrigerant philic surface(s) can be used to enhance refrigerant flow to, for example, bearings in oil free applications. The oleophobic or philic surface(s) described above can be utilized for the refrigerant phobic and/or refrigerant philic surface(s).

Figure 3:
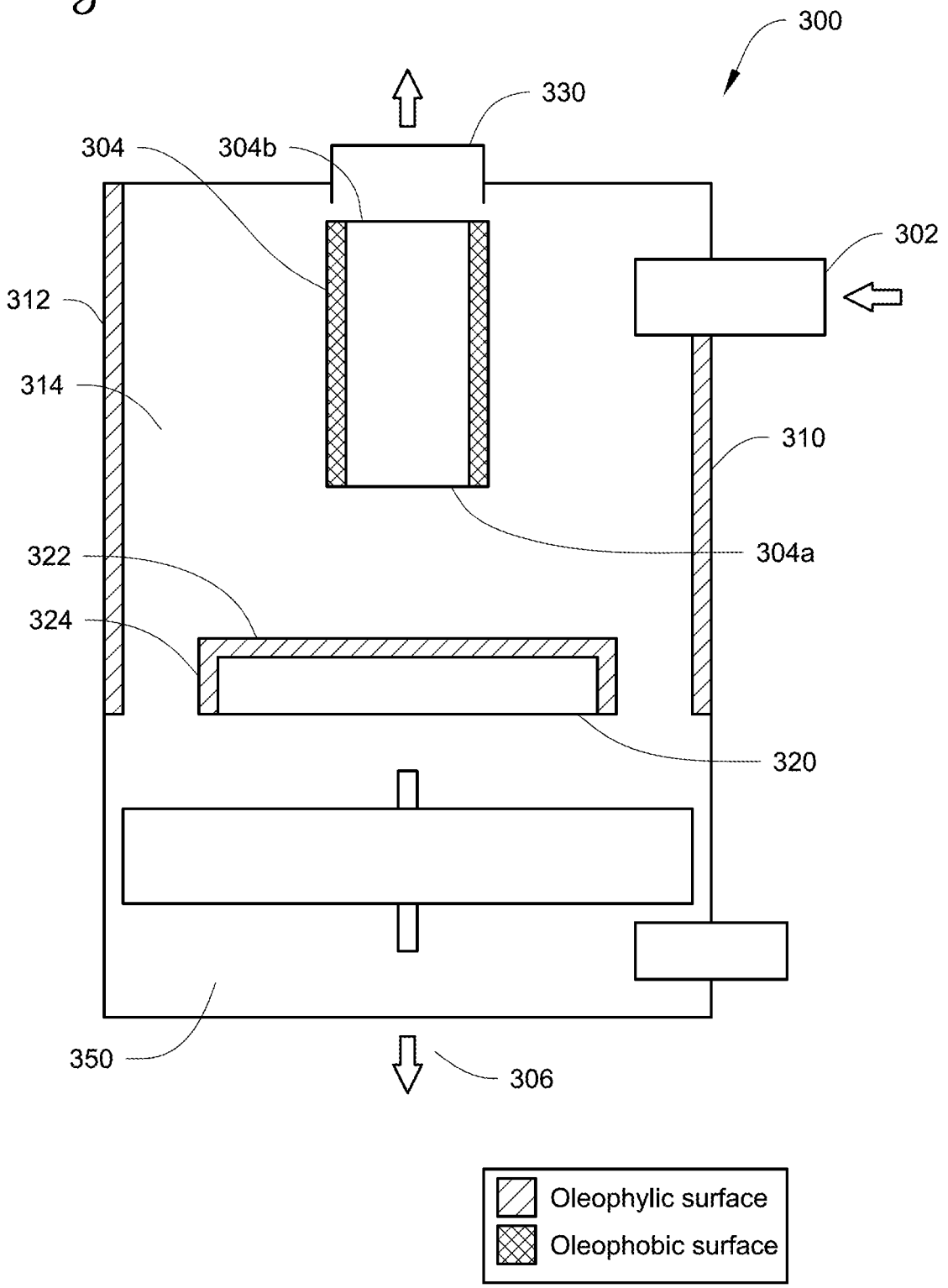
FIG. 3 illustrates a schematic side view of an oil separator incorporating oleophobic and/or philic surfaces, according to one embodiment.

FIG. 3 illustrates a schematic side view of an oil separator 300 for separating oil from refrigerant. The oil separator 300 incorporates oleophobic and/or philic surfaces for improved oil/refrigerant separation. The oil separator 300 includes a separator body 310 defining an inner space 314 and an inlet 302 for directing a mixture of oil/refrigerant vapor from, for example, a compressor (not shown), into the inner space 314. The oil and the refrigerant can be separated within the separator 300. The separated refrigerant vapor can be directed to a condenser. The separated oil can be directed back to the compressor.

The separator 300 further includes a refrigerant outlet 330 that includes a refrigerant outlet pipe 304 for directing the separated refrigerant vapor out of the separator 300 to, for example, the condenser. The refrigerant outlet pipe 304 has one open end 304*a* extending into the inner space 314 and the other end 304*b* connected to the refrigerant outlet 330. At least a portion of the outer surface of the outlet pipe 304 is configured to be oleophobic which can allow oil beading such that the oil can be stripped away from the outlet pipe 304. When oil comes into contact with the outer surface of the outlet pipe 304, the oil can be repelled by the oleophobic surface and aggregate for oil beading on the surface. This oil aggregation can be picked up by a refrigerant vapor flow (e.g., refrigerant with a high velocity) in the inner space 314 and prevent oil from dripping down along the outlet pipe 304 where the oil can be picked up by the refrigerant vapor entering the outlet pipe 304. In some embodiments, the inner surface of the outlet pipe 304 can also be configured to be oleophobic which can allow oil beading such that the oil can be stripped away from the outlet 330. The separated oil can be collected at a reservoir 350 at the bottom of the separator 300 and directed out of the separator via an oil outlet 306.

The separator body 310 includes a sidewall 312 with an inner surface facing the inner space 314. The separator 300 further includes a baffle plate 320 having an upper surface 322 facing the open end 304*a* of the refrigerant outlet pipe 304 and a side surface 324. One or more of the inner surface of the sidewall 312, the upper surface 322, and the side surface 324 of the baffle plate 320 are configured to be oleophilic surface(s) for preventing oil beading on the surface. The undesired oil beading can cause an increased oil profile that can be picked off of the wall by the refrigerant vapor, for example, a refrigerant vapor having high vapor velocities. The oleophilic surface(s) on the sidewall 312 and/or the baffle plate 320 allow the oil to hug the surfaces for greater effectiveness of oil drainage into the reservoir 350. This can enable lower oil circulation rates and/or decrease oil separator size/diameter for a given capacity.

Figure 4A:
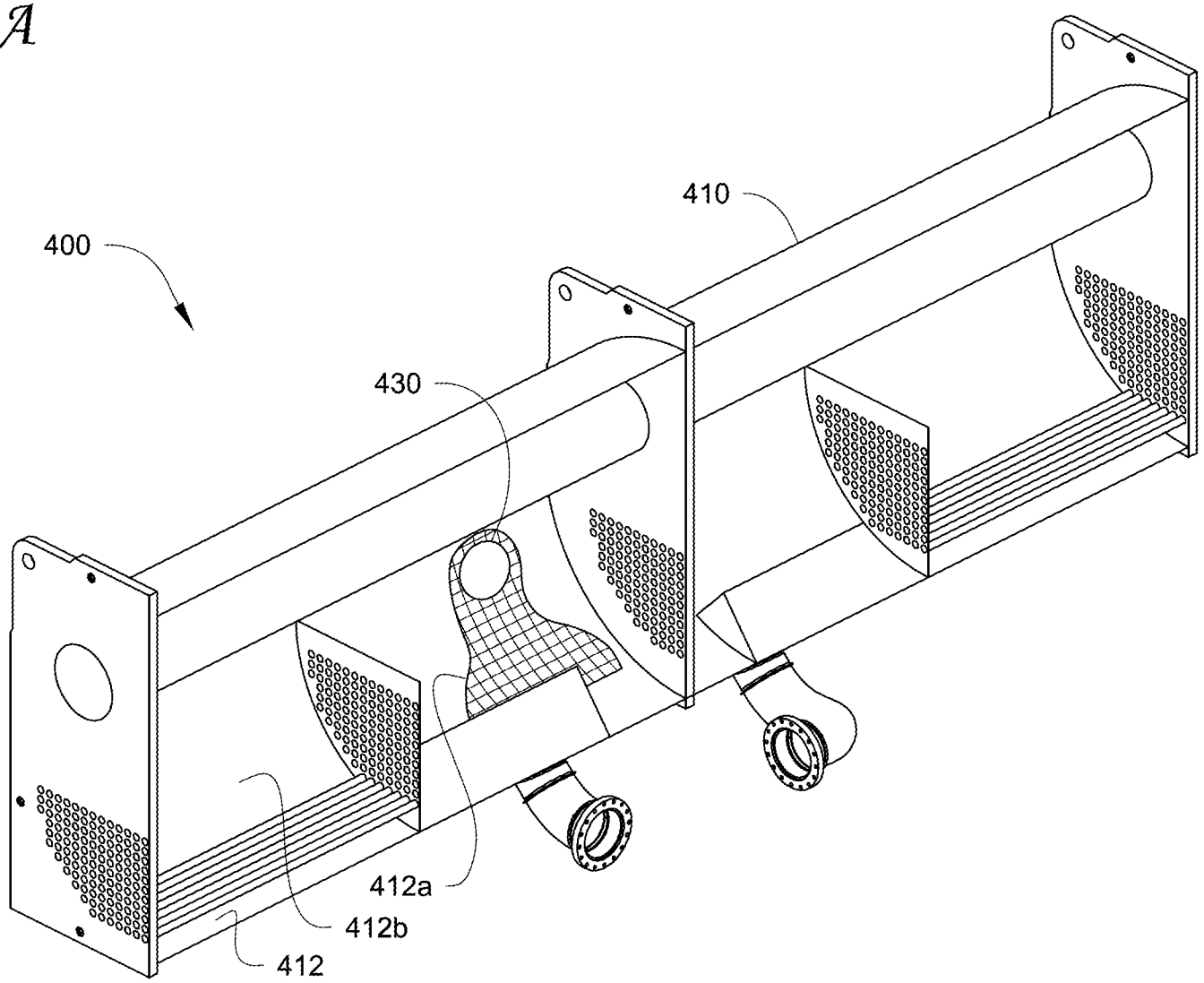
FIG. 4A illustrates a schematic side view of an evaporator, according to one embodiment.
Figure 4B:
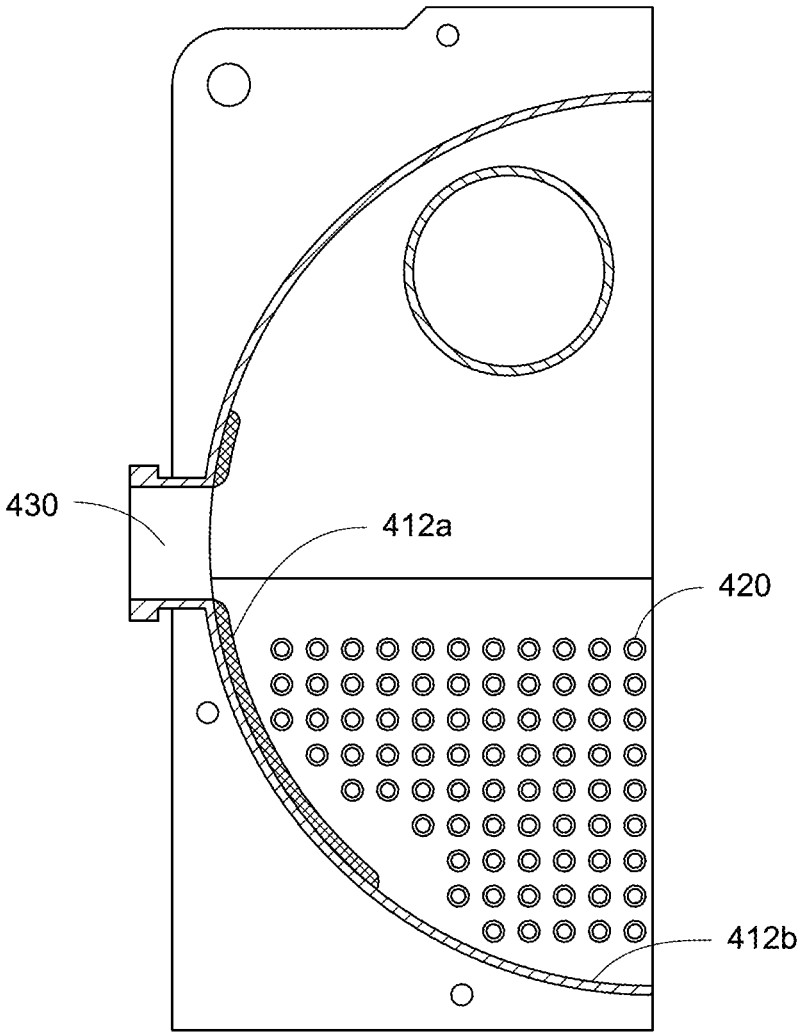
FIG. 4B illustrates a schematic end view of the evaporator of FIG. 4A.

FIG. 4A illustrates a schematic side view of an evaporator 400, according to one embodiment. FIG. 4B illustrates a partial schematic end view of the evaporator 400 of FIG. 4A. The evaporator 400 is a shell and a tube evaporator that includes a shell 410 and a tube bundle 420 inside the space defined by the shell 410. The evaporator 400 utilizes oleophobic and/or philic surface(s) for oil separation, direction, and/or collection therein. It is to be understood that oleophobic and/or philic surface(s) described herein are applicable to other heat exchangers such as, for example, a coil heat exchanger (e.g., a micro-channel heat exchanger (MCHE), a round tube/plate fin (RTPF) heat exchanger, etc.), a brazed plate heat exchanger (BPHE), a condenser, etc.

The shell 410 has an inside wall 412. A first portion of the inside wall 412, as shown by an area 412*a* of FIG. 4A, is configured to be oleophilic surface. The evaporator 400 includes a spillover port 430 that is adjacent the area 412*a*. When the oil comes into contact with the oleophilic surface of the inside wall 412, e.g., the area 412*a*, the oil can be attracted, adsorbed, or absorbed on the surface thereon. This can help direct oil from the area 412*a* towards the spillover port 430. A second portion of the inside wall 412 of the shell 410, as shown by an area 412*b* of FIG. 4A, e.g., the rest of the inside wall 412 adjacent the area 412*a*, may be configured to be an oleophobic surface lack of affinity for oil. The oleophobic surface (e.g., the area 412*b*) can help drive oil towards the oleophilic surface of the inside wall 412, e.g., the area 412*a*.

In some embodiments, an oleophilic or phobic surface within the evaporator 400 such as for example, the areas 412*a* and 412*b* of FIGS. 4A and 4B, can include surface enhancement patterns that can enhance the oil flow out of the evaporator 400. In some embodiments, the surface enhancement patterns can minimize foaming and oil concentration within the evaporator 400. In some embodiments, the surface enhancement patterns can be created through use of millimeter or micrometer and/or nanometer sized structure(s) on the surface of the component(s). In some embodiments, the surface enhancement patterns can be created through structures formed directly into the material of components of the refrigeration system. For example, milli, micro, and/or nanostructure(s) can be formed into the material of an oil separator, e.g., steel. In some embodiments, the surface enhancement patterns can be created through coating(s) that can be applied to the surfaces.

It is also to be understood that the oleophobic or philic surfaces described herein can be tailored to be phobic or philic for fluid other than oil (e.g., refrigerant) and can be used in other components of refrigeration and/or HVAC systems, for example, a heat exchanger. The fluid phobic or philic surface(s) can also be used for systems other than refrigeration and/or HVAC systems.

Figure 5:
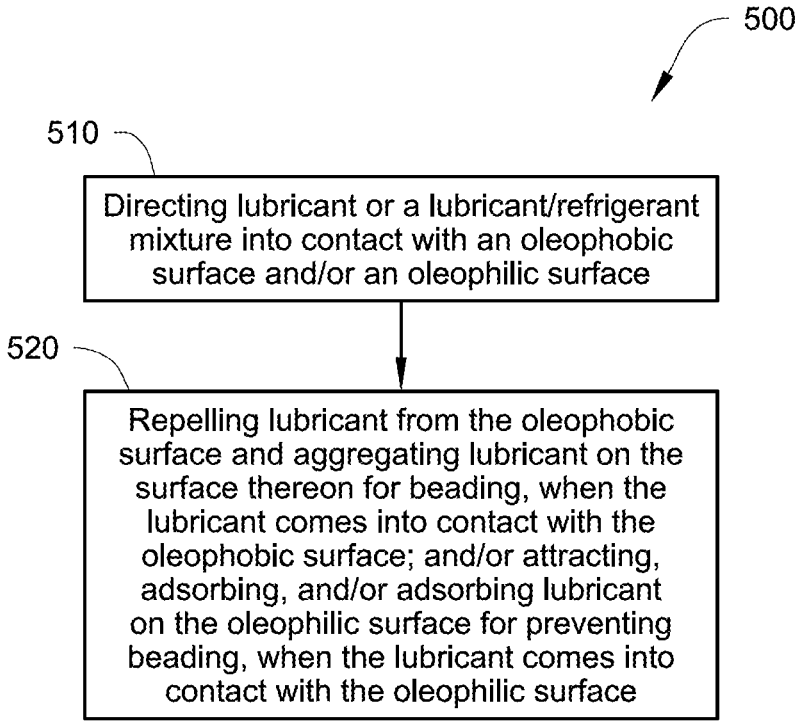
FIG. 5 illustrates a flow diagram of a method of utilizing oleophobic and/or oleophilic surface(s) for directing oil flow within refrigeration and/or HVAC systems, according to one embodiment.

FIG. 5 illustrates a flow diagram of a method 500 of utilizing oleophobic and/or oleophilic surface(s) for directing oil flow within refrigeration and/or HVAC systems. At 510, oil or an oil/refrigerant mixture is directed into contact with an oleophobic surface and/or an oleophilic surface. The method 500 then proceeds to 520. At 520, when the oil comes into contact with the oleophobic surface, the oil is repelled by the oleophobic surface and aggregates on the surface thereon for oil beading; when the oil comes into contact with the oleophilic surface, the oil can be attracted, adsorbed, and/or absorbed on the surface thereon and oil beading can be prevented.

Referring back to FIGS. 2A and 2B, in some embodiments, a method for directing oil flow inside a compressor is provided. The oil is directed into contact with an inner wall of an oil gallery passage and/or an inlet wall of the compressor, for example, the passage wall 60*a* and/or the inlet wall 172*a* of FIG. 2A. The inner wall can be created to be an oleophilic surface. When the oil comes into contact with the oleophilic surface, the oil can be attracted, adsorbed, and/or absorbed on the surface thereon and oil beading can be prevented. This can help wick the oil up to an end of the oil gallery passage.

Referring back to FIG. 3, in some embodiments, a method for directing oil flow inside an oil separator is provided. An oil/refrigerant vapor mixture is directed into contact with an oleophobic surface and/or an oleophilic surface. An inner wall of the oil separator, and/or the surface of a baffle plate such as, for example, one or more of the inner surface of the sidewall 312, the upper surface 322, and the side surface 324 of the baffle plate 320 of FIG. 3, can be created to be the oleophilic surface. An inner surface of a refrigerant outlet such as, for example, the refrigerant outlet pipe 304 of FIG. 3, can be created to be the oleophobic surface. When the oil and/or the oil/refrigerant vapor mixture comes into contact with the oleophilic surface, oil beading can be prevented. When the oil and/or the oil/refrigerant vapor mixture comes into contact with the oleophobic surface, oil beading can be allowed and oil can be stripped away from the oleophobic surface.

Referring back to FIGS. 4A and 4B, in some embodiments, a method for directing oil flow within an evaporator is provided. Oil is directed into contact with an oleophilic surface and/or an oleophobic surface. A first portion of an inner surface of the evaporator such as, for example, the area 412*a* of FIGS. 4A-B, can be created to be the oleophilic surface. A second portion of an inner surface of the evaporator such as, for example, the area 412*b* of FIGS. 4A-B, can be created to be the oleophobic surface. The oleophobic surface can help to direct oil to the oleophilic surface. The oleophilic surface can help to direct the oil to an oil return port.

Liquid Vapor Separation

The embodiments described herein are directed to applications of materials and/or structures for liquid/vapor separation in refrigeration and/or HVAC systems. It will be appreciated that further embodiments of fluid phobic and/or fluid philic surfaces could be used in a variety of liquid/vapor separators and applications. Such separators could be chemical separators, fuel separators, etc. For such applications the phobic and/or philic surfaces and/or materials may be suitably selected, arranged, constructed, or otherwise formed to meet the desired and/or necessary fluid properties.

In the embodiments described herein, refrigerant phobic and/or lubricant (e.g. oleo) phobic materials and/or structures are utilized to help promote separation of refrigerant vapor from refrigerant liquid and/or oil in refrigeration and/or HVAC systems. The refrigerant phobic and/or lubricant phobic materials and/or structures are disposed within the refrigeration and/or HVAC systems to repel refrigerant liquid and/or lubricant to increase the efficiency of separating refrigerant liquid from refrigerant vapor and/or separating oil from refrigerant vapor.

In some embodiments, the refrigerant phobic and/or lubricant phobic materials can be arranged as a screen that allows refrigerant vapor to pass through but not allow liquid droplets (refrigerant and/or oil) to penetrate. Separation characteristics of the refrigerant phobic and/or lubricant phobic materials can be adjusted through, for example, pore sizing. The pressure drop required to "push" the vapor through the refrigerant phobic and/or lubricant phobic materials material can be adjusted by, for example, changing pore size or changing of the liquid/vapor separator design. Pore sizes of the materials can be determined by application type, refrigerant/oil type, or pressure drop conditions and/or needs.

In some embodiments, material(s) of component(s) of refrigeration and/or HVAC systems can include the refrigerant phobic and/or lubricant phobic materials for promoting separation of refrigerant vapor from refrigerant liquid and/or from oil.

In some embodiments, the refrigerant phobic and/or lubricant phobic materials can include, by way of example but not limited to, any one or more of expanded polytetrafluoroethylene (ePTFE), polypropylene, polyesterterephthalate, polyurethane, etc.

Figure 6:
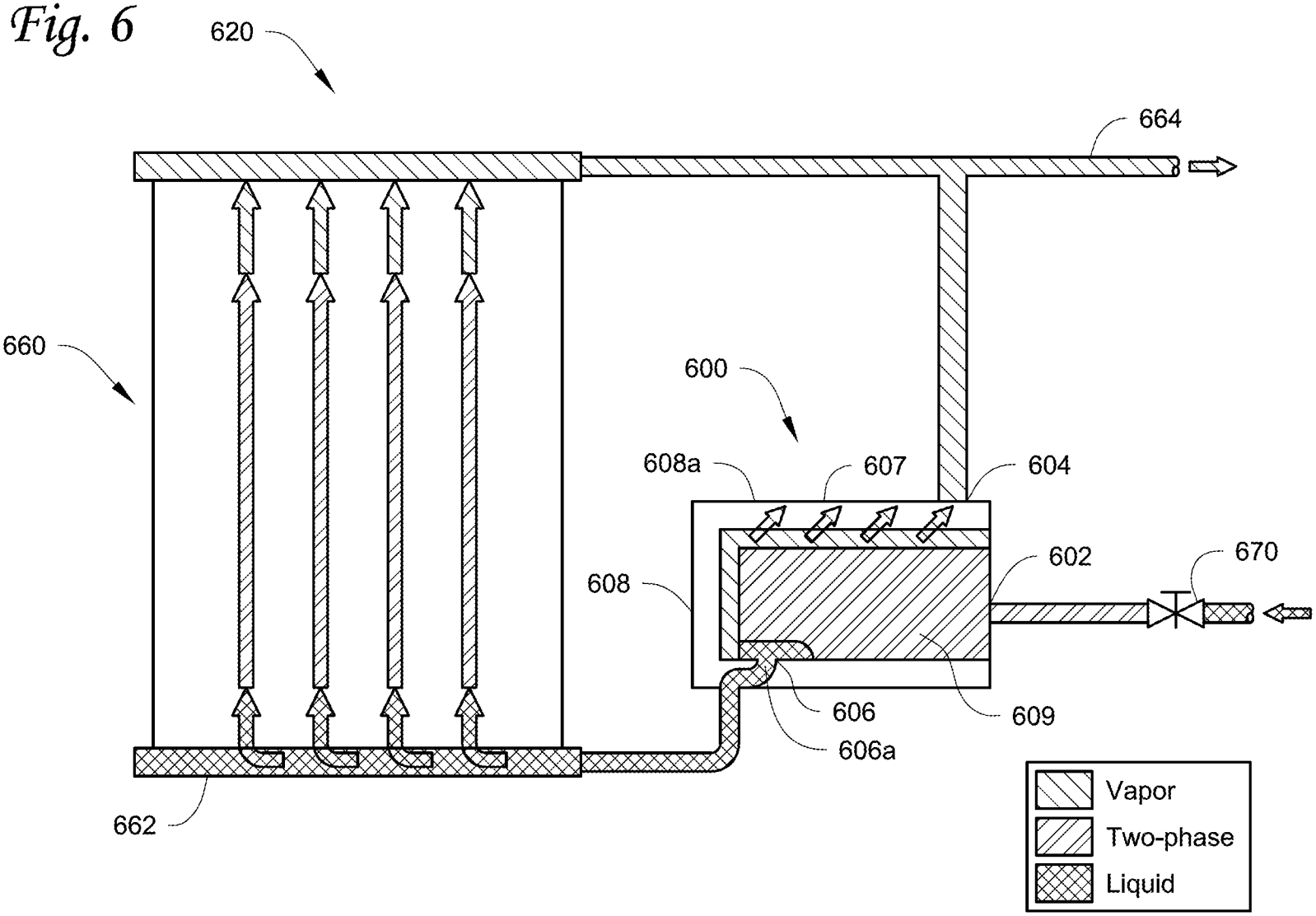
FIG. 6 illustrates a schematic diagram of a liquid/vapor separation system for single phase distribution in an evaporator, according to one embodiment.

FIG. 6 illustrates a separator 600 for a refrigeration system 620. The refrigeration system 620 includes an evaporator 660, a distributor 662, an expansion device 670, and the separator 600. In some embodiments, the evaporator 660 can be, for example, a coil heat exchanger that can include, for example, a micro-channel heat exchanger (MCHE), a round tube/plate fin (RTPF) heat exchanger, etc. In some embodiments, the evaporator 660 can be a brazed plate heat exchanger (BPHE). In some embodiments, the evaporator 660 can be a shell and tube (e.g., falling film) evaporator. It is to be understood that the evaporator 660 can be other suitable types of evaporators that may have a two-phase (i.e., liquid and gas) flow therein.

The separator 600 is disposed fluidly downstream of the expansion device 670 and upstream of the evaporator 660. The separator 600 is fluidly connected to the expansion device 670 via an inlet 602, connected to a suction 664 of a compressor (not shown) via an outlet 604, and fluidly connected to the distributor 662 via an outlet 606.

In some embodiments, the separator 600 can include a canister 607 that has walls 608 defining a space 609. Refrigerant in a two phase condition (liquid and vapor) may be directed into the space 609 via the inlet 602. The walls 608 include an upper partition 608*a* that contains refrigerant phobic and/or lubricant phobic materials configured to help separate refrigerant liquid from refrigerant vapor and to separate lubricant (e.g., oil) from the refrigerant vapor. Refrigerant phobic and/or lubricant phobic materials can include materials that are used in a wide variety of applications for water/air separation or filtration. Refrigerant phobic and/or lubricant phobic materials include, for example, any one or more of ePTFE, polypropylene, polyesterterephthalate, or polyurethane materials. The ePTFE can be a basis of GoreTex® material which has been used for waterproof/breathable materials for clothing.

In some embodiments, the refrigerant phobic and/or lubricant phobic materials can be in the form of membrane(s). In some embodiments, the refrigerant phobic and/or lubricant phobic materials can be impregnated with milli/micro/nano-fibers and/or milli/micro/nano-structures.

As shown in FIG. 6, the upper partition 608*a* includes refrigerant phobic and/or lubricant phobic material(s) that allow the refrigerant vapor to pass therethrough and does not allow the refrigerant liquid and/or lubricant to pass therethrough. The separated refrigerant vapor is directed from the separator 600 to the suction 664 via the outlet 604 and directed to the compressor (not shown). The separated refrigerant liquid is collected at a bottom region of the separator 600 and can be drained out of the separator 600 via an opening 606*a* at a bottom region of the sidewall 608.

In some embodiments, the canister 607 can have a polygonal shape or other suitable shape. The walls 608 can include refrigerant phobic and/or lubricant phobic materials that can be in the form of, for example, a sheet. The space 609 is defined by the walls 608 and the outlet 606 is formed on a bottom wall of the walls 608. The refrigerant vapor can pass through the upper partition 608*a*, and the refrigerant liquid and/or lubricant can be directed to the outlet 606.

In some embodiments, the expansion device 670 can be controlled to provide additional pressure drop for the refrigerant vapor to pass through the upper partition 608*a*.

The refrigerant liquid drained out from the outlet 606 can be directed to the distributor 662 and the distributor 662 can distribute the refrigerant liquid to the evaporator 660.

As shown in FIG. 6, the separator 600 is disposed upstream of the distributor 662. In some embodiments, the separator 600 can be disposed within a distributor to separate refrigerant liquid from refrigerant vapor. The refrigerant phobic and/or lubricant phobic materials of the separator 600 can be utilized in the form of, for example, membrane(s) to direct refrigerant vapor, for example towards an outside of the distributor and/or direct refrigerant liquid to a middle region of the distributor.

Embodiments described herein allow for better distribution of the refrigerant liquid within the evaporator, for example, within tubes of the evaporator. This can also help create distributors with lower cost and evaporators with better performance through better distribution of the refrigerant liquid.

The separator 600 can separate the refrigerant liquid from the mixture of the refrigerant liquid and vapor, and provide the refrigerant liquid for the distributor 662 to distribute the refrigerant liquid into the evaporator 660. Since distribution of refrigerant in liquid (e.g., single phase distribution) can be desired as compared to distribution of refrigerant in two phases (e.g., a mixture of liquid and vapor), the refrigeration system 620 can obtain better performance for the evaporator 660. For example, with a single phase distribution (e.g., distribution of refrigerant liquid), better heat exchanger performance can be obtained at a wide range of operation conditions, including, for example, full load and/or partial load conditions of the refrigeration system. In addition, the design of the distributor 662 may be simplified and cost-reduced. Also, in a single phase distribution, even distribution can be more easily obtained for a wide range of refrigeration and/or HVAC systems.

Figure 7:
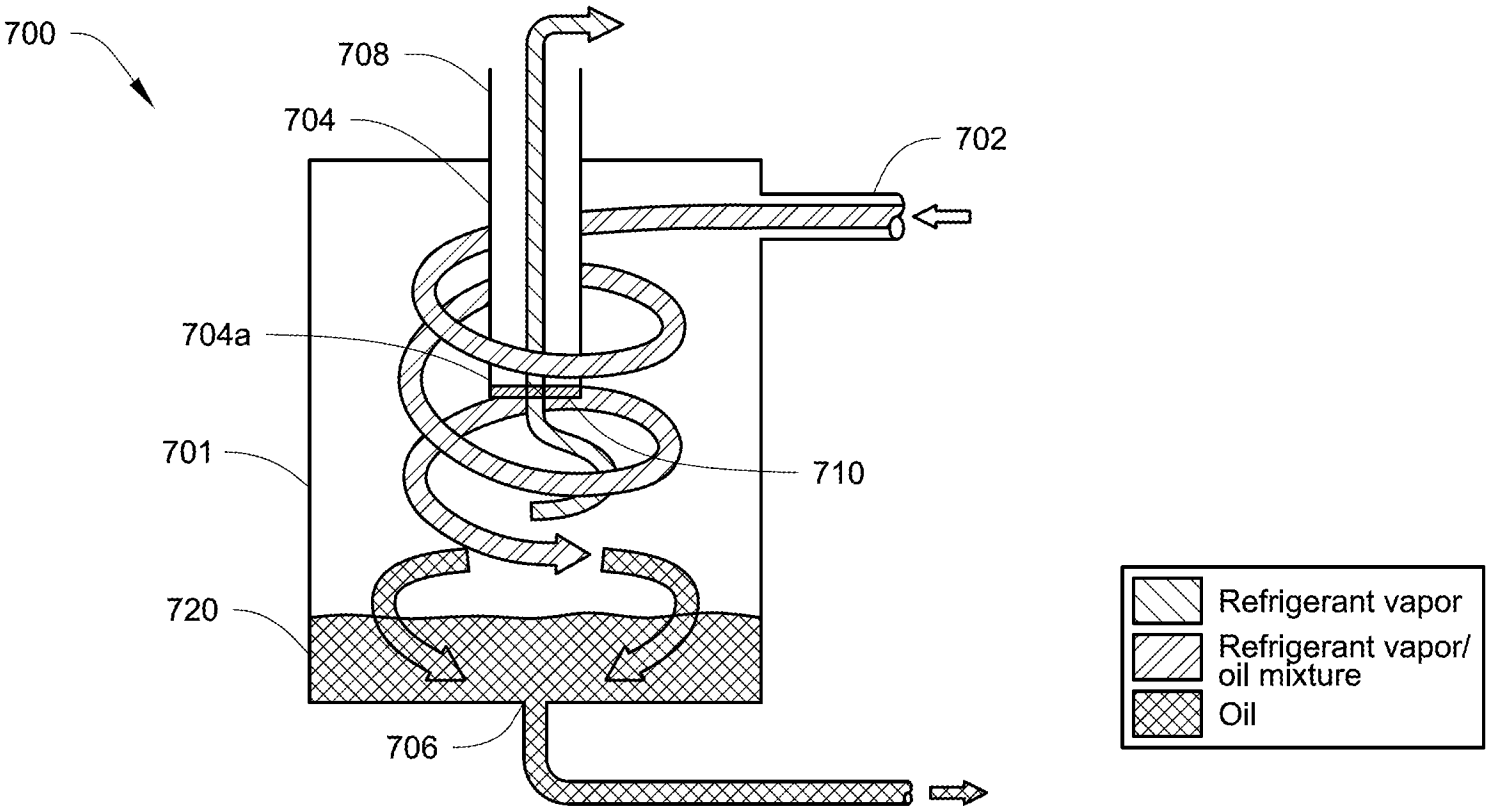
FIG. 7 illustrates a schematic diagram of an oil separator utilizing membranes for oil/refrigerant separation, according to one embodiment.

FIG. 7 illustrates a schematic diagram of an oil separator 700 utilizing an oil barrier device 710 for separation of oil from refrigerant vapor, according to one embodiment. The oil separator 700 includes a tank 701 that receives a mixture of refrigerant vapor and oil from a compressor (not shown) via a discharge inlet 702. The oil separator 700 further includes a vapor outlet 704 that extends into the space defined by the tank 701. The vapor outlet 704 has an open end 704*a* that faces the inside of the tank 701.

The oil barrier device 710 is disposed at the open end 704*a* of the vapor outlet 704 or at other openings that may exist in the wall of vapor outlet 704. The oil barrier device 710 includes refrigerant phobic and/or lubricant phobic materials, for example, arranged as a screen. The oil barrier device 710 can prevent oil from exiting the separator 700 via an outlet 708 to a condenser (not shown) and allow the refrigerant vapor to penetrate and exit the separator 700 via the outlet 708 to the condenser (not shown). In some embodiments, the oil barrier device 710 can be in other suitable forms such as, for example, a mesh, a filter, etc. The separated oil is collected at a bottom region 720 of the separator 700 and is directed back to the compressor via an oil outlet 706. The separated refrigerant vapor passes through the oil barrier device 710 and is directed to the condenser (not shown) via the outlet 708.

The refrigerant phobic and/or lubricant phobic materials contained in the oil barrier device 710 include, for example, any one or more of ePTFE, polypropylene, polyesterterephthalate, or polyurethane materials. The materials can be arranged in a form of a membrane, mesh, filter, screen, etc., that have a pore size distribution that is determined to ensure a minimal pressure drop for the oil/refrigerant vapor separation.

In some embodiments, the refrigerant phobic and/or lubricant phobic materials contained in the oil barrier device 710 allow the separated oil to drain into the bottom region 720 before the oil saturates in the oil barrier device 710 so that the separated oil does not inhibit the refrigerant vapor from passing through the oil barrier device 710.

In some embodiments, the refrigerant phobic and/or lubricant phobic materials contained in the oil barrier device 710 can include materials that can resist high temperatures, for example, the temperature of a mixture of refrigerant vapor and oil discharged from a compressor In some embodiments, the oil separator 700 can be utilized in refrigeration and/or HVAC systems where decreased oil circulation rates may be desired and/or needed. The oil barrier device 710 can enhance refrigerant/oil separation within the oil separator 700 without significantly increasing the volume of the oil separator 700 and/or minimizing the oil circulation rate therethrough.

Figure 8A:
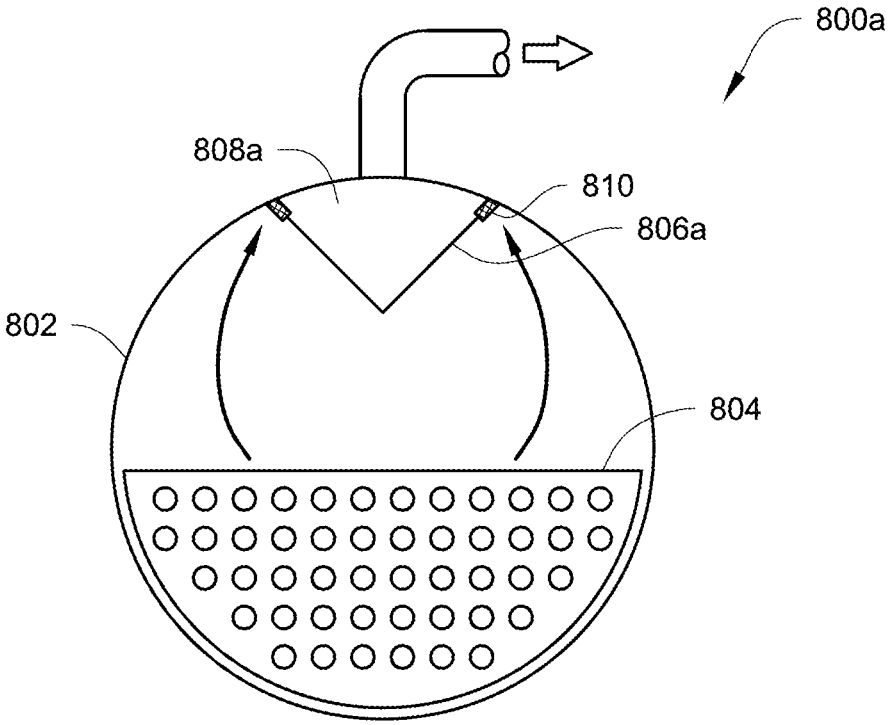
FIG. 8A illustrates a schematic side view of an evaporator, according to one embodiment.
Figure 8B:
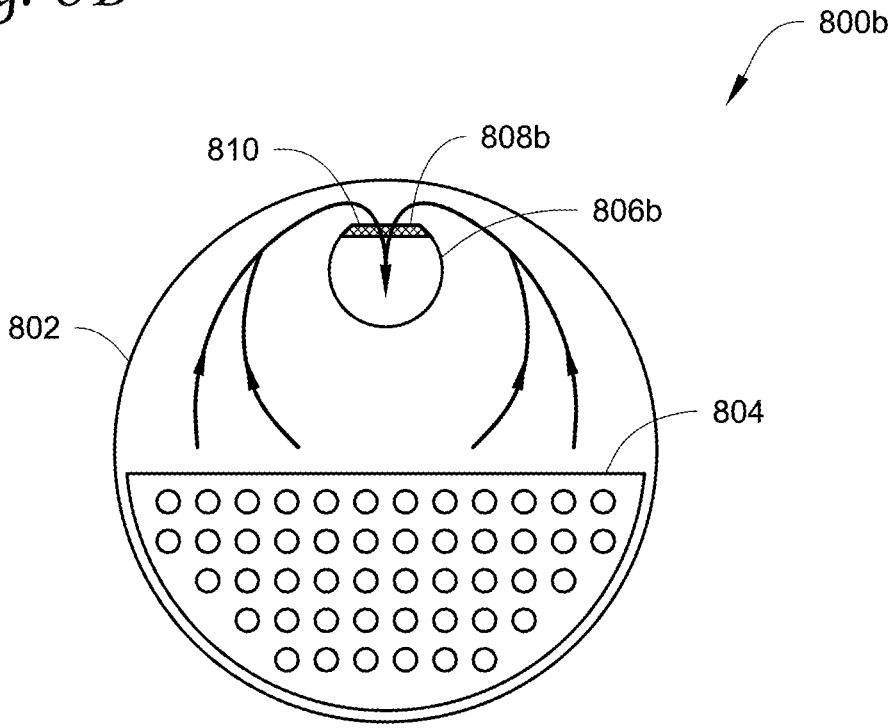
FIG. 8B illustrates a schematic side view of another evaporator, according to one embodiment.

FIGS. 8A-B illustrate an evaporator 800*a*, 800*b* that includes a liquid carryover abatement device 810. The evaporator 800*a*, 800*b* is a shell and tube evaporator that includes a body 802 that houses a tube bundle 804. Refrigerant liquid or liquid/vapor mixture flows through the tube bundle 804 and absorbs heat to evaporate. It is to be understood that the evaporator 800*a*, 800*b* can be other types of evaporators such as, for example, a coil heat exchanger, a brazed plate heat exchanger (BPHE), a falling film heat exchanger, etc.

The refrigerant vapor is directed into a suction duct 806*a*, 806*b* via an opening 808*a*, 808*b* respectively defined by the suction duct 806*a*, 806*b*. The liquid carryover abatement device 810 is disposed as, for example, a screen at the opening 808*a*, 808*b*. The liquid carryover abatement device 810 allows the refrigerant vapor to exit the evaporator 800*a*, 800*b* via the suction duct 806*a*, 806*b* and prevents refrigerant liquid and lubricant (e.g., oil) from exiting the evaporator 800*a*, 800*b*. The liquid carryover abatement device 810 is arranged as, for example, a screen, that includes refrigerant phobic and/or lubricant phobic materials. The materials can be in the form of, for example, membrane(s), or can be impregnated with milli/micro/nano-fibers or milli/micro/nano-structures. The refrigerant phobic and/or lubricant phobic materials of the liquid carryover abatement device 810 include, for example, any one or more of EPTFE, polypropylene, polyesterterephthalate, or polyurethane materials. The refrigerant phobic and/or lubricant phobic materials can effectively decrease the liquid carryover with the refrigerant vapor through the vapor outlet 808*a*, 808*b*.

Figure 8C:
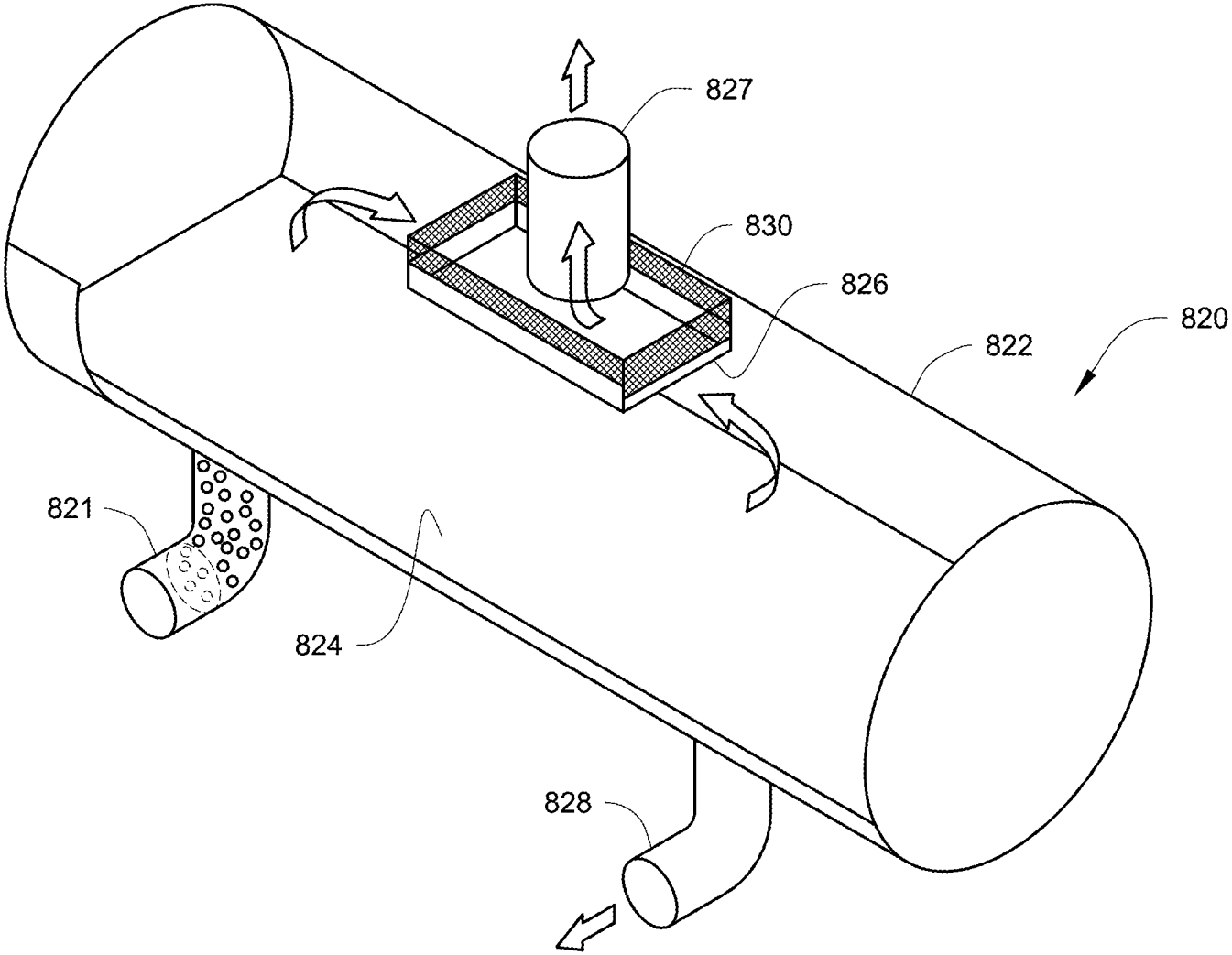
FIG. 8C illustrates a 3D view of an economizer, according to one embodiment.

FIG. 8C illustrates one embodiment of an economizer 820 that includes a liquid carryover abatement device 830. The economizer 820 may be a shell and tube economizer that includes a body 822 through which refrigerant liquid or liquid/vapor mixture 824 flows for liquid/vapor separation, such as for example from an expansion device such as the orifice in line 821 and from a condenser.

The refrigerant vapor is directed into a suction duct 826 via an opening partially or wholly covered by the liquid carryover abatement device 830. In some embodiments, the liquid carryover abatement device 830 is disposed as, for example, a screen at the opening. The liquid carryover abatement device 830 can allow the refrigerant vapor to exit the economizer 820 via the suction duct 826 and prevents refrigerant liquid from exiting the economizer 820, which can exit through line 828 to for example an evaporator. In one embodiment, such as shown in FIG. 8C, the liquid carryover abatement device 830 is arranged as, for example, a screen, that includes refrigerant phobic and/or lubricant phobic materials. The materials can be in the form of, for example, membrane(s), or can be impregnated with milli/micro/nano-fibers or milli/micro/nano-structures. The refrigerant phobic and/or lubricant phobic materials of the liquid carryover abatement device 830 include, for example, any one or more of EPTFE, polypropylene, polyesterterephthalate, or polyurethane materials. The refrigerant phobic and/or lubricant phobic materials can effectively decrease the liquid carryover with the refrigerant vapor through the vapor outlet 827

Figure 9A:
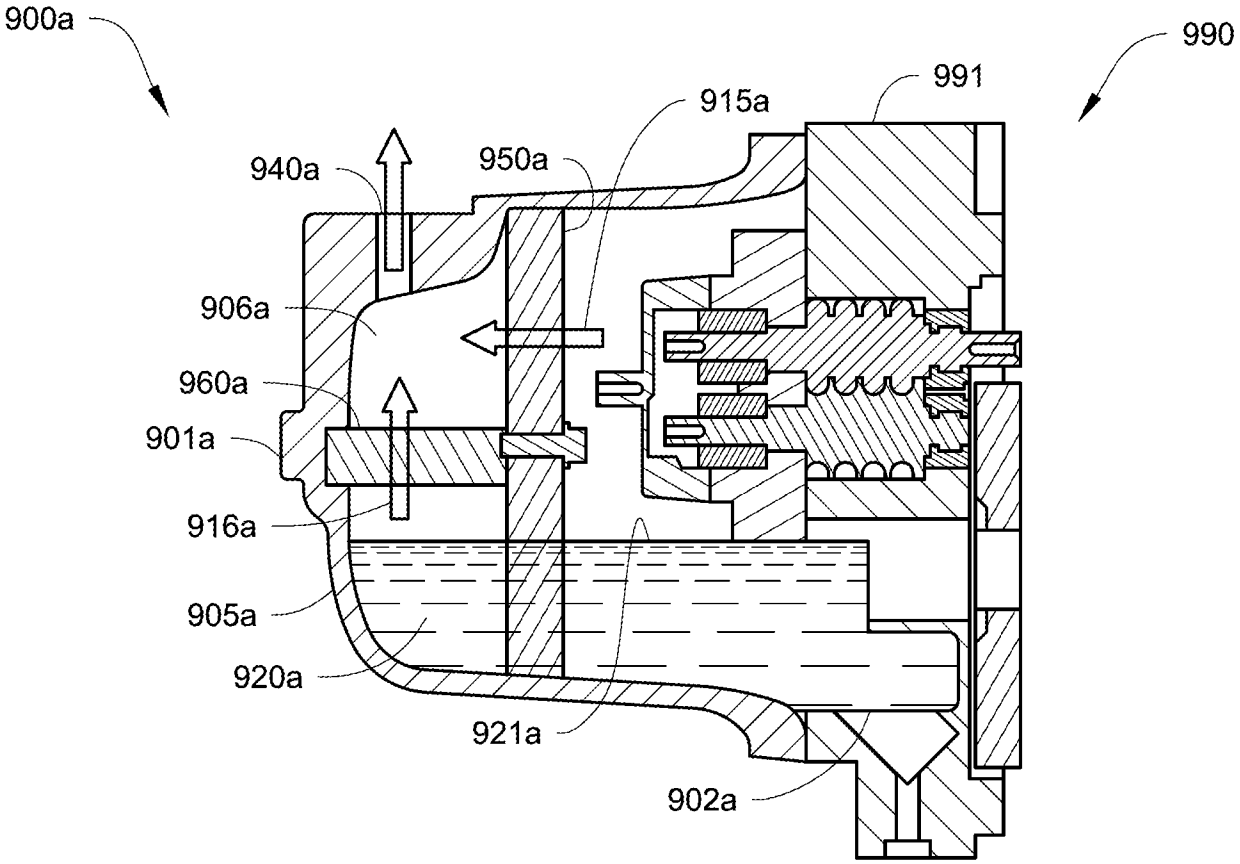
FIG. 9A illustrates a partial sectional side view of an internal oil separator, according to one embodiment.

FIG. 9A illustrates a partial sectional side view of an internal oil separator 900*a*, according to one embodiment. The internal oil separator 900*a* includes a separator housing 905*a* that defines a separator space 906*a*. The housing 905*a* includes a closed end 901*a* and an opposite open end 902*a* that is configured to engage a compressor housing 991 of a compressor 990. A mixture of refrigerant vapor and oil (e.g., bearing returning oil) is directed from the inside of the compressor 990 into the separator space 906*a* through the open end 902*a*, as shown by an arrow 915*a*. The internal oil separator 900*a* is configured to separate refrigerant vapor from oil inside the compressor 990. This can eliminate the need for an external oil separator for use with an evaporator.

The internal oil separator 900*a* in some embodiments includes for example a partition 950*a* which may be oriented vertically and that extends through the separator space 906*a*. The partition 950*a* includes refrigerant liquid and/or lubricant phobic materials. The partition 950*a* allows the refrigerant vapor to penetrate therethrough and generally prevents oil droplets in the mixture from penetrating therethrough. The separated oil is collected in a bottom area 920*a* of the separator space 906*a* with an oil level 921*a*. The separated refrigerant vapor is directed out of the separator space 906*a* via an outlet 940*a*. It will be appreciated that in some embodiments, the outlet 940*a* may have openings disposed on a wall, such as on a circumference of the wall of the outlet 940*a* or on a line fluidly connected to the outlet 940*a*.

The internal oil separator 900*a* in some embodiments further includes another partition 960*a*, which may be oriented laterally and that extends from the closed end 901*a* to the partition 950*a*. The partition 960*a* may be disposed above the oil level 921*a*, can allow the refrigerant vapor from the bottom area 920*a* to penetrate therethrough and can prevent oil droplets in the mixture from penetrating therethrough. The separated refrigerant vapor can be directed out of the separator space 906*a* via the outlet 940*a*, as shown by an arrow 916*a*. The separated oil can then be directed back to the bottom area 920*a*.

The refrigerant phobic and/or lubricant phobic materials that may be included on the partitions 950*a* and 960*a* can include, for example, any one or more of ePTFE, polypropylene, polyesterterephthalate, or polyurethane. In some embodiments, the materials can be arranged in a form of a membrane, mesh, filter, screen, etc. In some embodiments, the materials can be in the form of a membrane and can be adhered to the surface of a substrate made of, for example, metal. In some embodiments, the membrane may be used in conjunction with a wire mesh for oil separation augmentation. In some embodiments, the membrane can be pleated to increase surface area. In some embodiments, the refrigerant phobic and/or lubricant phobic materials can be impregnated with milli/micro/nano-fibers or milli/micro/nano-structures to increase the efficiency of the materials for oil/refrigerant vapor separation in the internal oil separator 900*a*.

In some embodiments, the refrigerant phobic and/or lubricant phobic materials contained in the partitions 950*a* and 960*a* can be configured to allow the separated oil to drain into the bottom region 920*a* before the oil saturates in the partitions 950*a* and 960*a* so that the separated oil does not inhibit the refrigerant vapor from passing therethrough.

In some embodiments, the internal oil separator 900*a* can further include components (not shown) for separating oil/refrigerant using traditional method(s) such as, for example, centrifugal force, impingement, etc. The partitions 950*a* and/or 960*a* that include the refrigerant phobic and/or lubricant phobic materials can be disposed downstream of the components for separating oil/refrigerant using the traditional methods.

In some embodiments, the internal oil separator 900*a* can be inside a screw compressor where decreased oil circulation rates may be desired and/or needed to enhance the performance of heat exchanger(s). The refrigerant phobic and/or lubricant phobic materials contained therein can promote oil/refrigerant vapor separation in the internal oil separator 900*a*. It is to be understood that the internal oil separator 900*a* can be integrated with other suitable compressors.

Figure 9B:
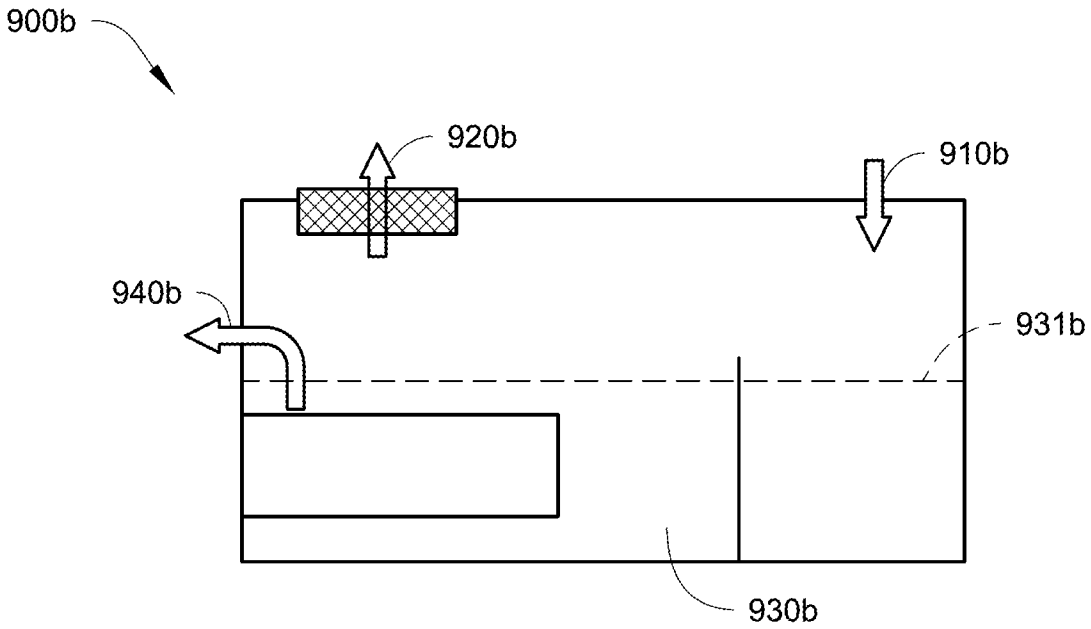
FIG. 9B illustrates a schematic side view of another oil separator, according to one embodiment.

FIG. 9B illustrates a schematic side view of an oil tank 900*b*, according to one embodiment. The oil tank 900*b* can be internal to the compressor or can be a physically separate shell from the compressor, for example can be located near the floor of a centrifugal chiller at a lower level than for example the compressor, and the oil tank can incorporate a pump (not shown) and which may be internal to the tank. The oil tank 900*b* includes an inlet 910*b* configured to receive a mixture of refrigerant vapor and oil (e.g., bearing return oil) from a compressor (not shown). The oil tank 900*b* further includes an outlet 920*b* configured to direct refrigerant vapor out of the oil tank 900*b*. The oil separated from the refrigerant vapor is collected at a bottom area 930*b* with an oil level 931*b* and directed out of the separator 900*b* via an oil outlet 940*b* that is connected to an oil supply to compressor bearings (not shown). In one embodiment, the oil tank 900*b* can be suitable as an oil tank for a centrifugal compressor. It is to be understood that other types of oil tanks can be used such as an integrated oil tank/pump.

The oil tank 900*b* includes refrigerant phobic and/or lubricant phobic material(s) for example, in the form of, e.g., a membrane, disposed at the outlet 920*b*. The refrigerant phobic and/or lubricant phobic materials allow the refrigerant vapor to penetrate therethrough and prevent oil droplets (e.g., potential carryover) in the mixture from penetrating along with the refrigerant vapor. It will be appreciated that in some embodiments, the outlet 920*b* may have openings disposed on a wall of a pipe fluidly connected to the outlet 920*b*, and may be disposed, such as on a circumference of the wall. The refrigerant phobic and/or lubricant phobic materials disposed at the outlet 920*b* include, for example, any one or more of ePTFE, polypropylene, polyesterterephthalate, or polyurethane. In some embodiments, the materials can be arranged in a form of a membrane, a mesh, a filter, a screen, etc. In some embodiments, the materials can be bonded to a substrate made of, for example, metal.

In some embodiments, the oil tank 900*b* can be used as an oil sump where the refrigerant phobic and/or lubricant phobic material can be used in a vent line thereof to reduce oil quantity carried out of the oil tank, especially for example, during a hot-start and/or foaming conditions. The refrigerant phobic and/or lubricant phobic material provided for the vent line can prevent oil exiting an outlet (e.g., the outlet 920*b*) and can reduce or eliminate the loss of oil.

Figure 10:
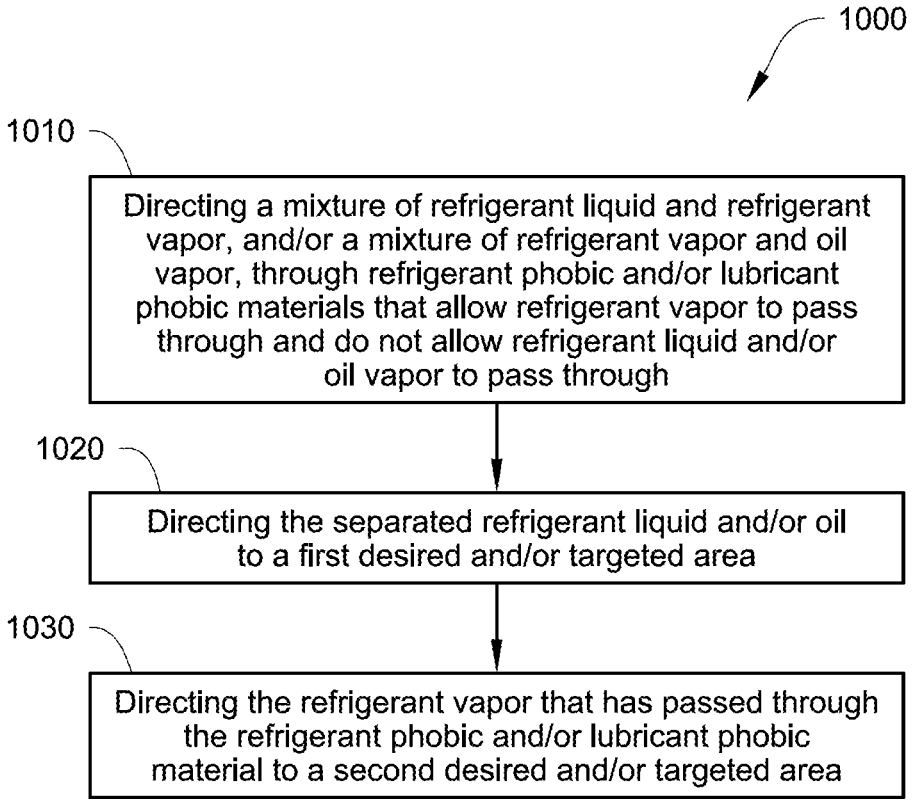
FIG. 10 illustrates a flow diagram of a method for separating refrigerant vapor from refrigerant liquid and/or from oil in refrigeration and/or HVAC systems, according to one embodiment.

FIG. 10 illustrates a flow diagram of a method 1000 for separating refrigerant vapor from refrigerant liquid and/or from oil in refrigeration and/or HVAC systems. At 1010, a mixture of refrigerant liquid and refrigerant vapor, and/or a mixture of refrigerant vapor and oil, is directed through refrigerant phobic and/or lubricant phobic material(s) that allow refrigerant vapor to pass through and do not allow refrigerant vapor and/or oil to pass through. The method 1000 then proceeds to 1020. At 1020, the separated refrigerant liquid and/or oil is directed to a first desired and/or targeted area. The method 500 then proceeds to 1030. At 1030, the refrigerant vapor that has passed through the refrigerant phobic and/or lubricant phobic materials is directed to a second desired and/or targeted area.

In some embodiments, a method for separating refrigerant liquid from refrigerant vapor is provided. A mixture of refrigerant liquid and vapor can be directed from an expansion device, e.g., the expansion device 670 in FIG. 6, through refrigerant phobic and/or lubricant phobic materials such as, for example, the materials contained in the separator 600. The refrigerant vapor can pass through the refrigerant phobic and/or lubricant phobic materials and be directed to a compressor via a suction such as, for example, the suction 664. The refrigerant vapor does not pass through the refrigerant phobic and/or lubricant phobic materials and be distributed to an evaporator such as, for example, the evaporator 660.

In some embodiments, a method for separating oil from refrigerant vapor is provided. A mixture of refrigerant vapor and oil can be directed from a compressor through refrigerant phobic and/or lubricant phobic materials such as, for example, the materials contained in the oil barrier device 710 in FIG. 7. The refrigerant vapor can pass through the refrigerant phobic and/or lubricant phobic materials and be directed to a condenser. The oil does not pass through the refrigerant phobic and/or lubricant phobic materials and can be directed back to the compressor.

In some embodiments, a method for decreasing refrigerant liquid carryover in refrigerant vapor is provided. When refrigerant vapor is directed out of an evaporator or economizer, the refrigerant vapor is directed through refrigerant phobic and/or lubricant phobic materials such as, for example, the materials contained in the liquid carryover abatement device 810, 830. The refrigerant vapor can pass through the refrigerant phobic and/or lubricant phobic materials and exit the evaporator or economizer. The refrigerant liquid mixed with the refrigerant vapor can be repelled by the refrigerant phobic and/or lubricant phobic materials and does not pass through the materials to exit the evaporator or economizer.

Aspects

Any of aspects 1 to 5 may be combined with any of aspects 6 to 44, any of aspects 6 to 11 may be combined with any of aspects 12 to 44, any of aspects 12 to 15 may be combined with any of aspects 16 to 44, and any of aspects 16 to 19 may be combined with any of aspects 20 to 44, and any of aspects 20 to 23 may be combined with any of aspects 24 to 44, and any of aspects 24 to 27 may be combined with any of aspects 28 to 44, and any of aspects 28 to 31 may be combined with any of aspects 32 to 44, and any of aspects 32 to 36 may be combined with any of aspects 37 to 44, and any of aspects 37 to 40 may be combined with any of aspects 41 to 44.

1. A compressor in a refrigeration system, comprising: an inner surface area exposed to the inside of the compressor, when the compressor operates, a lubricant flowing inside the compressor comes into contact with the inner surface area, the inner surface area configured to be a lubricant phobic or philic surface so as to direct the flow of the lubricant.

2. The compressor of aspect 1, wherein the lubricant phobic or philic surface includes millimeter, micrometer, and/or nanometer sized structure(s) on the surface thereof.

3. The compressor of aspect 1 or 2, wherein the lubricant phobic or philic surface includes a coating on the surface thereof.

4. The compressor of any of aspects 1 to 3, wherein the lubricant phobic or philic surface is an oleophobic or philic surface.

5. The compressor of any of aspects 1 to 4, wherein the compressor is an oil-free compressor and the lubricant phobic or philic surface is a refrigerant phobic or philic surface.

6. An oil separator in a refrigerant system for separating oil from a refrigerant/oil mixture, comprising:

an inner surface area exposed to the inside of the oil separator, when the oil separator operates, at least a portion of the separated oil or the refrigerant/oil mixture comes into contact with the inner surface area, the inner surface area configured to be an oleophobic or philic surface so as to direct the flow of oil and help separate the oil from the refrigerant.

7. The oil separator of aspect 6, wherein the oleophobic or philic surface includes millimeter, micrometer, and/or nanometer sized structure(s) on the surface thereof.

8. The oil separator of aspect 6 or 7, wherein the oleophobic or philic surface includes a coating on the surface thereof.

9. The oil separator of any of aspects 6 to 8, further comprising: a refrigerant outlet tube for directing separated refrigerant out of the oil separator, at least a portion of an inner wall surface of the refrigerant outlet tube configured to be oleophobic for allowing oil beading.

10. The oil separator of any of aspects 6 to 9, further comprising: a separator body having a side wall, at least a portion of the side wall configured to be oleophilic to prevent oil beading.

11. The oil separator of any of aspects 6 to 10, further comprising: a baffle plate having an upper surface and a side surface that are configured to be oleophilic to prevent oil beading.

12. An evaporator in a refrigerant system, comprising: an inner surface area that exposes to an inside of the evaporator, when the evaporator operates, oil inside the evaporator comes into contact with the inner surface area, the inner surface area configured to be an oleophobic or philic surface so as to direct the flow of oil.

13. The evaporator of aspect 12, wherein the oleophobic or philic surface includes millimeter, micrometer, and/or nanometer sized structure(s) on the surface thereof.

14. The evaporator of aspect 12 or 13, wherein the oleophobic or philic surface includes a coating on the surface thereof.

15. The evaporator of any of aspects 12 to 14, further comprising a shell having an inside wall, a first portion of the inner wall including an oleophilic surface, a second portion of the inner wall including an oleophobic surface, the oleophilic surface and the oleophobic surface being positioned to direct the oil from the oleophobic surface to the oleophilic surface and to an oil return port of the evaporator.

16. A method of utilizing oleophobic and/or oleophilic surface(s) for directing oil flow within a refrigeration and/or HVAC system, comprising: directing oil or an oil/refrigerant mixture into contact with an oleophobic surface and/or an oleophilic surface; and at least one of: (i) repelling oil from the oleophobic surface and aggregating oil on the surface thereon for oil beading, when the oil comes into contact with the oleophobic surface; and (ii) attracting, adsorbing, and/or absorbing oil on the oleophilic surface for preventing oil beading, when the oil comes into contact with the oleophilic surface.

17. The method of aspect 16, wherein the oleophilic surface and/or the oleophobic surface is an inner surface area exposed to the inside of a compressor.

18. The method of aspect 16 or 17, wherein the oleophilic surface and/or the oleophobic surface is an inner surface area exposed to the inside of an oil separator.

19. The method of any of aspects 16 to 18, wherein the oleophilic surface and/or the oleophobic surface is an inner surface area that exposes to an inside of an evaporator.

20. A refrigeration system, comprising: an expansion device; a refrigerant liquid/vapor separator downstream of the expansion device, the refrigerant liquid/vapor separator configured to receive refrigerant liquid/vapor mixtures from the expansion device; a distributor downstream of the refrigerant liquid/vapor separator, the distributor receiving refrigerant liquid from the refrigerant liquid/vapor separator; and an evaporator fluidly connected to the distributor for receiving the refrigerant liquid distributed by the distributor, wherein the refrigerant liquid/vapor separator contains refrigerant phobic and/or lubricant phobic materials for promoting separation of the refrigerant liquid from the refrigerant vapor.

21. The refrigeration system of aspect 20, wherein the refrigerant phobic and/or lubricant phobic materials include at least one of expanded polytetrafluoroethylene (ePTFE), polypropylene, polyesterterephthalate, and polyurethane.

22. The refrigeration system of aspect 20 or 21, wherein the refrigerant phobic and/or lubricant phobic materials are in a form of a membrane.

23. The refrigeration system of any of aspects 20 to 22, wherein the refrigerant phobic and/or lubricant phobic materials are impregnated with milli/micro/nano-fibers or milli/micro/nano-structures.

24. An oil separator for a refrigeration system, comprising: a tank including an inlet for receiving a mixture of refrigerant vapor and oil, an oil outlet at a bottom region of the tank for directing out liquid oil, and a vapor outlet for directing out refrigerant vapor, the vapor outlet having an open end facing the inside of the tank and/or openings disposed on and through a wall of the vapor outlet; and an oil barrier device disposed at the open end or the openings of the wall of the vapor outlet of the vapor outlet, the oil barrier device including refrigerant phobic and/or lubricant phobic materials for preventing oil from exiting the tank while allowing for the refrigerant vapor to penetrate there through and exit the tank via the vapor outlet.

25. The oil separator of aspect 24, wherein the refrigerant phobic and/or lubricant phobic materials include at least one of expanded polytetrafluoroethylene (ePTFE), polypropylene, polyesterterephthalate, and polyurethane.

26. The oil separator of aspect 24 or 25, wherein the refrigerant phobic and/or lubricant phobic materials are in a form of a membrane.

27. The oil separator of any of aspects 24 to 26, wherein the refrigerant phobic and/or lubricant phobic materials are impregnated with milli/micro/nano-fibers or milli/micro/nano-structures.

28. An evaporator in a refrigeration system, comprising: an evaporator body; a suction duct disposed at a vapor outlet of the body for directing refrigerant vapor out of the evaporator, the suction duct having an opening to receive the refrigerant vapor; a liquid carryover abatement device disposed at the opening of the suction duct for allowing the refrigerant vapor to penetrate and preventing refrigerant liquid and lubricant from exiting the evaporator via the vapor outlet, the liquid carryover abatement device including refrigerant phobic and/or lubricant phobic materials.

29. The evaporator of aspect 28, wherein the refrigerant phobic and/or lubricant phobic materials include at least one of expanded polytetrafluoroethylene (ePTFE), polypropylene, polyesterterephthalate, and polyurethane membranes.

30. The evaporator of aspect 28 or 29, wherein the refrigerant phobic and/or lubricant phobic materials are in a form of a membrane.

31. The evaporator of any of aspects 28 to 30, wherein the refrigerant phobic and/or lubricant phobic materials are impregnated with milli/micro/nano-fibers or milli/micro/nano-structures.

32. A compressor internal oil separator for a refrigeration system, comprising: a housing including an open end configured to receive a mixture of refrigerant vapor and oil from an insider of a compressor, and a vapor outlet configured to direct out refrigerant vapor; and one or more partitions separating the open end from the vapor outlet, one or more of the partitions including a phobic and/or lubricant phobic material for preventing oil from passing through the walls while allowing for the refrigerant vapor to penetrate through the walls and exit the housing via the vapor outlet, the separated oil being collected in a bottom area of the housing.

33. The compressor internal separator of aspect 32, wherein the refrigerant phobic and/or lubricant phobic materials include at least one of expanded polytetrafluoroethylene (ePTFE), polypropylene, polyesterterephthalate, and polyurethane.

34. The compressor internal separator of aspect 32 or 33, wherein the refrigerant phobic and/or lubricant phobic materials are in a form of a membrane.

35. The compressor internal separator of any of aspects 32 to 34, wherein the refrigerant phobic and/or lubricant phobic materials are impregnated with milli/micro/nano-fibers or milli/micro/nano-structures.

36. The compressor internal separator of any of aspects 32 to 35, wherein the partitions include a vertical partition and a lateral partition.

37. A method for separating refrigerant vapor from refrigerant liquid and/or from oil within a refrigeration system, the method comprising: directing a mixture of refrigerant liquid and refrigerant vapor, and/or a mixture of refrigerant vapor and oil, through refrigerant phobic and/or lubricant phobic material(s) that allow refrigerant vapor to pass through and do not allow refrigerant vapor and/or oil to pass through.

38. The method of aspect 37, further comprising directing the separated refrigerant liquid to an evaporator, and directing the separated refrigerant vapor to a compressor.

39. The method of aspect 37 or 38, further comprising directing the separated oil to a compressor, and directing the separated refrigerant vapor to a condenser.

40. The method of any of aspects 37 to 39, further comprising directing the separated refrigerant vapor out of an evaporator, and keeping the separated refrigerant liquid in the evaporator.

41. An economizer in a refrigeration system, comprising: an economizer body having a vapor outlet; a suction duct disposed at the vapor outlet of the economizer body for directing refrigerant vapor out of the economizer, the suction duct having an opening to receive the refrigerant vapor; a liquid carryover abatement device disposed at the opening of the suction duct for allowing the refrigerant vapor to penetrate and exit the vapor outlet and for preventing refrigerant liquid from exiting the economizer via the vapor outlet, the liquid carryover abatement device including refrigerant phobic and/or lubricant phobic materials.

42. The economizer of aspect 41, wherein the refrigerant phobic and/or lubricant phobic materials include at least one of expanded polytetrafluoroethylene (ePTFE), polypropylene, polyesterterephthalate, and polyurethane membranes.

43. The economizer of aspect 41 or 42, wherein the refrigerant phobic and/or lubricant phobic materials are in a form of a membrane.

44. The economizer of any of aspects 41 to 43, wherein the refrigerant phobic and/or lubricant phobic materials are impregnated with milli/micro/nano-fibers or milli/micro/nano-structures.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What claimed is:

1. A refrigeration system, comprising:

in a compressor, an inner surface area exposed to the inside of the compressor, when the compressor operates, a lubricant flowing inside the compressor comes into contact with the inner surface area of the compressor, the inner surface area of the compressor configured to be a lubricant phobic or philic surface so as to direct the flow of the lubricant, the inner surface area being an inner surface of a lubricant passage for supplying lubricant to an interface along a moving surface within the compressor.

2. The system of claim 1, wherein the compressor is an oil-free compressor and the lubricant phobic or philic surface is a refrigerant phobic or philic surface.

3. The system of claim 1, wherein the inner surface of the lubricant passage is one or more of:

a surface of a wall of an oil gallery, and a surface of a wall of an inlet disposed at one end of the oil gallery, the inlet in fluid communication with the oil gallery.

4. The system of claim 1, wherein the inner surface is configured to be an oleophilic surface.

5. The system of claim 1, wherein the lubricant passage is configured to supply lubricant to a bearing of the compressor.

* * * * *